United States Patent [19]

Koya et al.

[11] Patent Number: 5,073,473

[45] Date of Patent: Dec. 17, 1991

[54] METHOD OF FORMING AN IMAGE BY SILVER SALT DIFFUSION TRANSFER

[75] Inventors: Keizo Koya; Yoshio Idota, both of Kanagawa, Japan

[73] Assignee: Fuji Photo Film Co., Ltd., Kanagawa, Japan

[21] Appl. No.: 467,292

[22] Filed: Jan. 16, 1990

Related U.S. Application Data

[63] Continuation of Ser. No. 188,561, Apr. 29, 1988, abandoned.

[30] Foreign Application Priority Data

Apr. 30, 1987 [JP] Japan ..... 62-104498

[51] Int. Cl.[5] ..... G03C 5/54

[52] U.S. Cl. ..... 430/247; 430/223; 430/227; 430/233; 430/234; 430/244; 430/248; 430/249; 430/251; 430/955

[58] Field of Search ..... 430/223, 233, 244, 248, 430/227, 249, 251, 234, 247, 955, 957

[56] References Cited

U.S. PATENT DOCUMENTS

| | | | |
|---|---|---|---|
| 3,020,155 | 2/1962 | Yackel et al. | 430/248 |
| 3,379,529 | 4/1968 | Porter et al. | 430/957 |
| 4,047,952 | 9/1977 | Pfaff | 430/234 |
| 4,288,522 | 9/1981 | Carael et al. | 430/233 |
| 4,612,277 | 9/1986 | Inagaki | 430/248 |
| 4,683,189 | 7/1987 | Idota et al. | 430/248 |
| 4,693,955 | 9/1987 | Torizuka et al. | 430/251 |
| 4,783,396 | 11/1988 | Nakamura et al. | 430/223 |

*Primary Examiner*—Richard L. Schilling

*Attorney, Agent, or Firm*—Sughrue, Mion, Zinn, Macpeak & Seas

[57] ABSTRACT

A method for forming an image by silver salt diffusion transfer is described, comprises processing an image-wise exposed photosensitive element provided with a layer of photosensitive silver halide emulsion on a support, and an image-receiving element provided with an image-receiving layer containing a silver-precipitating agent on a support, with an alkali processing composition in the presence of a silver halide solvent, to convert at least part of the unexposed silver halide in the emulsion layer into a transferable silver complex salt, to transfer at least part of said complex salt into the image-receiving layer, and to form an image in the image-receiving layer; the processing being carried out in the presence of at least one compound as described.

15 Claims, No Drawings

METHOD OF FORMING AN IMAGE BY SILVER SALT DIFFUSION TRANSFER

This is a continuation of application Ser. No. 07/188,561, filed Apr. 29, 1988, now abandoned.

FIELD OF THE INVENTION

This invention relates to a method for forming images by means of silver salt diffusion transfer, and film units with which this method is employed.

BACKGROUND OF THE INVENTION

Methods of forming images by means of diffusion transfer using silver salts such as silver halides etc. are well known. In practical terms, the method involves, for example, processing a photosensitive silver halide emulsion layer which has been subjected to image exposure in an aqueous alkaline bath which contains a developing agent, a silver halide solvent and a film forming agent (thickening agent); reducing the exposed silver halide grains to silver with the developing agent while converting the unexposed silver halide grains to a transferable silver complex salt by means of the silver halide solvent; diffusion transfer of the silver complex salt by inhibition to a silver precipitating agent containing layer (image receiving layer) which is laminated to the aforementioned emulsion layer; and reducing the complex silver salt with a developing agent, with the assistance of the silver precipitating agent to form a silver image.

This method is normally used in film units composed of a photosensitive element consisting of a photosensitive silver halide emulsion layer on a support, an image receiving element consisting of a silver precipitating agent containing image receiving layer on a support, and a processing element containing an active alkaline aqueous solution which contains developing agent, silver halide solvent and film forming agent, inside a rupturable container. The emulsion layer of the photosensitive element is first subjected to image exposure, after which the photosensitive element and the image receiving element are laminated together in such a way that the said emulsion layer is facing the image receiving layer of the image receiving element, while rupturing the processing element and spreading the viscous alkaline aqueous solution between the two layers by passing the unit between a pair of rollers. The film unit is then left to stand for a prescribed length of time and a print with an image formed in the image receiving layer is obtained by peeling the image receiving element away from the photosensitive element.

Methods of forming images by silver salt diffusion transfer using automatic developing machines and involving the use of a developing bath and a fixing bath or an activator bath containing an alkaline reagent and a fixing liquid, or a single development and fixing bath, as used in the printing industry, are also effective.

In silver salt diffusion transfer photographic processes of this type the processing liquid components are involved in both the development and dissolution of the silver halide, and the development of the image on the silver precipitation nuclei, and unwanted side reactions are liable to occur. For example, the silver halide solvent in the processing liquid may act not only to dissolve the silver halide in the photosensitive element but also to inhibit the development of the image on the silver precipitation nuclei. However, if the solvent is included in the photosensitive element the material will not withstand long term storage. Furthermore, toning agents may act not only in the development of the image on the silver precipitation nuclei but also to inhibit the development of the silver halide. Moreover, image stabilizers included in the image receiving layer not only protect the developed silver from oxidation after development but may also inhibit the development of the image on the silver precipitation nuclei and so the image stabilizers must be located in the lower layers of the image receiving element. Consequently, control of timing for image stabilization and reduction of the inhibition of development are very difficult, and in practice conventional units exhibit a considerable risk of development inhibitation. For this reason compounds which release an image stabilizer as a result of the action of an alkaline agent have been used in the past. These methods cannot be used in systems where acetyl cellulose has been alkali saponified in order to render the layer which contains the silver precipitation nuclei hydrophilic.

Moreover, methods in which a fogging agent (nucleating agent) is included in the photosensitive element have been suggested as a means of stopping the development of the photosensitive layer, but these fogging agents are powerful reducing agents and are liable to become deactivated over long periods of time. Furthermore, the difference in reducing activity with respect to the developing agent is subtle; if the compound is much more active than the developing agent then no image will be formed, while if its activity is very weak the compound will be unable to stop development. Hence the release of a highly active fogging agent with good timing after development in undeveloped areas would be ideal but this has not been achieved in practice.

SUMMARY OF THE INVENTION

One aim of this invention is to provide a method of silver salt diffusion transfer which overcome these disadvantages.

It has now been discovered that these and other objects of this invention are achieved by a method for forming an image by silver salt diffusion transfer comprising processing an imagewise exposed photosensitive element provided with a layer of photosensitive silver halide emulsion on a support, and an image-receiving element provided with an image-receiving layer containing a silver-precipitating agent on a support, with an alkali processing composition in the presence of a silver halide solvent, to convert at least part of the unexposed silver halide in the emulsion layer into a transferable silver complex salt, to transfer at least part of said complex salt into the image-receiving layer, and to form an image in the image-receiving layer; the processing being carried out in the presence of at least one compound represented by general formula (I):

$$PWR\text{-}(Time)_t\text{-}PUG, \quad (I)$$

wherein PWR represents a group capable of releasing —(Time)$_t$—PUG by an oxidation-reduction reaction; Time represents a group capable of releasing PUG after —(Time)$_t$—PUG is released from PWR; t is 0 or 1; and PUG represents a photographically useful group.

DETAILED DESCRIPTION OF THE INVENTION

The compounds used in this invention are described in greater detail below, beginning with the PWR group.

PWR may be a group containing an election accepting center and an intramolecular nucleophilic substitution reaction center, which releases a reagent for photographic purposes by means of an intramolecular nucleophilic substitution reaction following reduction, as disclosed in U.S. Pat. Nos. 4,139,389, 4,139,379 and 4,564,577 and Japanese Patent Application (OPI) Nos. 185333/84, 190172/84 and 84453/82 (the term "OPI" as used herein means a "published unexamined Japanese patent application"). Alternatively it may be a group which contains an electron accepting quinonoid center linked by a carbon atom to a reagent for photographic purposes, and eliminates the reagent by means of an intramolecular electron transfer reaction following reduction, as disclosed in U.S. Pat. No. 4,232,107, Japanese Patent Application (OPI) Nos. 101649/84 and 88257/86 *and Research Disclosure* (1984) IV, No. 24025. Furthermore, PWR may be a group which contains an aryl group which is substituted with electron attractive groups linked by an atom (sulfur atom, carbon atom or nitrogen atom) to a reagent for photographic purposes, in which a single bond is cleaved and the reagent is released following reduction, as disclosed in West German Patent Application (OLS) No. 3,008,588 and in U.S. Pat. Nos. 4,343,893 and 4,619,884. Furthermore, PWR may be a groups which contains a nitro group linked by a carbon atom to a reagent for photographic purposes in a nitro compound which releases a reagent for photographic purposes after accepting an electron, as disclosed in U.S. Pat. No. 4,450,223. It may be a group which contains a geminal dinitro moiety linked by a carbon atom to a reagent for photographic purposes in a dinitro compound in which the reagent is $\beta$-eliminated after an electron has been accepted, as disclosed in U.S. Pat. No. 4,609,610.

Preferred compounds represented by the general formula [I] are those in which PWR represents a group

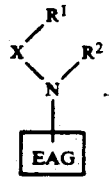

Those preferred compounds are represented by general formula [II]:

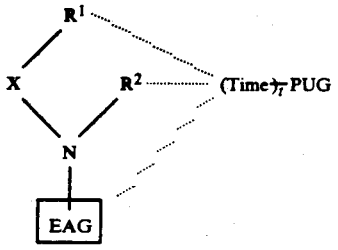

(II)

wherein X represents an oxygen atom, a sulfur atom or a group

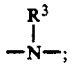

$R^1$, $R^2$ and $R^3$, which may be the same or different, each represents a group other than a hydrogen atom or a simple bond; EAG represents an aromatic group which accepts electrons from a reducing substance; provided that at least one of $R^1$, $R^2$ and EAG is bonded to —(Time)$_T$—PUG, $R^1$ and $R^2$ may each represent a simple bond to —(Time)$_T$—PUG; and any of $R^1$, $R^2$, $R^3$ and EAG may be linked to form at least one five-membered to eight-membered ring.

Examples of $R^1$, $R^2$ and $R^3$, which are groups other than hydrogen atoms, include substituted or unsubstituted alkyl groups, aralkyl groups (e.g., a methyl group, trifluoromethyl group, benzyl group, chloromethyl group, dimethylaminomethyl group, ethoxycarbonylmethyl group, aminomethyl group, acetylaminomethyl group, ethyl group, 2-(4-dodecanoylaminophenyl)ethyl group, carboxyethyl group, 3,3,3-trichloropropyl group, n-propyl group, isopropyl group, n-butyl group, iso-butyl group, sec-butyl group, t-butyl group, n-pentyl group, sec-pentyl group, t-pentyl group, cyclopentyl group, n-hexyl group, sec-hexyl group, t-hexyl group, cyclohexyl group, n-octyl group, sec-octyl group, t-octyl group, n-decyl group, n-undecyl group, n-dodecyl group, n-tetradecyl group, n-pentadecyl group, n-hexadecyl group, sec-hexadecyl group, t-hexadecyl group, n-octadecyl group, t-octadecyl group), substituted or unsubstituted alkenyl groups (e.g., a vinyl group, an allyl group, 2-chlorovinyl group, 1-methylvinyl group, 2-cyanovinyl group, cylcohexen-1-yl group), substituted or unsubstituted alkynyl groups (e.g., an ethynyl group, 1-propynyl group, 2-ethoxycarbonylethynyl group), substituted or unsubstituted aryl group (e.g., a phenyl group, naphthyl group, 3-hydroxyphenyl group, 3-chlorophenyl group, 4-acetylaminophenyl group, 4-hexadecanesulfonylaminophenyl group, 2-methanesulfonyl-4-nitrophenyl group, 3-nitrophenyl group, 4-methoxyphenyl group, 4-acetylaminophenyl group, 4-methanesulfonylphenyl group, 2,4-dimethylphenyl group, 4-tetradecyloxyphenyl group), substituted or unsubstituted heterocyclic group (e.g., a 1-imidazolyl group, 2-furyl group, 2-pyridyl group, 5-nitro-2-pyridyl group, 3-pyridyl group, 3,5-dicyano-2-pyridyl group 5-tetrazolyl group, 5-phenyl-1-tetrazolyl group 2-benzthiazolyl group, 2-benzimidazolyl group, 2-benzoxazolyl group, 2-oxazolin-2-yl group, morpholino group), a substituted or unsubstituted acyl group (e.g., an acetyl group, propionyl group, butyroyl group, iso-butyroyl group, 2,2-dimethylpropionyl group, benzoyl group, 3,4-dichlorobenzoyl group, 3-acetylamino-4-methoxybenzoyl group, 4-methylbenzoyl group, 4-methoxy-3-sulfobenzoyl group), a substituted or unsubstituted sulfonyl group (e.g., a methanesulfonyl group, ethane-sulfonyl group, chloromethanesulfonyl group, propane-sulfonyl group, butanesulfonyl group, n-octanesulfonyl group, n-dodecanesulfonyl group, n hexadecanesulfonyl group, benzenesulfonyl group, 4-toluenesulfonyl group, 4-n-dodecyloxybenzenesulfonyl group), a substituted or unsubstituted carbamoyl group (e.g., a carbamoyl group, methylcarbamoyl group, dimethylcarbamoyl group, bis-(2-methoxyethyl)carbamoyl group, diethylcarbamoyl group, cyclohexylcarbamoyl group, di-n-octylcarbamoyl group, 3-dodecyloxypropylcarbamoyl group, hexadecylcarbamoyl group, 3-(2,4-di-t-pentylphenoxy)propylcarbamoyl group, 3-octane-sulfonylaminophenylcarbamoyl group, di-n-octadecyl-carbamoyl group), or a substituted or unsubstituted sulfamoyl group (e.g., a sulfamoyl group, methylsulfamoyl group, dimethylsulfamoyl group, diethylsulfamoyl group, bis-(2-methoxyethyl)sulfamoyl group, di-n-butylsulfamoyl group, methyl-n-octylsulfamoyl group, n-hexadecylmethyl-sulfamoyl group, 3-ethoxypropylmethylsulfamoyl group, N-phenyl-N-methylsulfamoyl group, 4-decyloxyphenylsulfamoyl group, methyloctadecylsulfamoyl group).

$R^1$ and $R^2$ preferably each represents a substituted or unsubstituted alkyl group, a substituted or unsubstituted alkenyl group, a substituted or unsubstituted alkynyl group, a substituted or unsubstituted aryl group, a substituted or unsubstituted heterocyclic group, a substituted or unsubstituted acyl group, or a substituted or unsubstituted sulfonyl group. The number of carbon atoms in each of $R^1$ and $R^3$ is preferably from 1 to 40.

$R^2$ preferably represents a substituted or unsubstituted acyl group or a substituted or unsubstituted sulfonyl group containing from 1 to 40 carbon atoms.

Preferred compounds represented by general formula [II] are represented by general formula [III]:

(III)

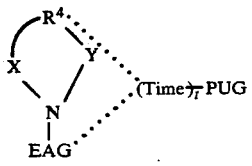

wherein X and EAG are the same as defined in general formula [II]; Y is a divalent linking group, and is preferably a

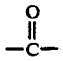

group or an —$SO_2$—group; $R^4$ represents a group of atoms necessary for forming a five-membered to eight-membered single or condensed heterocyclic ring containing the nitrogen atom; and —(Time)$_t$—PUG is bonded to at least one of $R^4$ and EAG.

In general formula [III] the group:

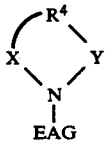

corresponds to PWR in general formula [I].

These compounds are preferred in view of the increased tolerance and freedom connected with the characteristics of the compound and synthetic design.

Preferred examples of such heterocyclic rings formed by $R^4$ include the following:

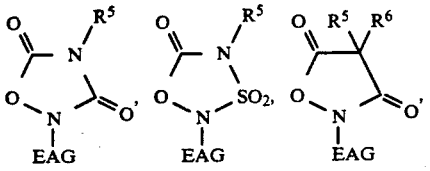

-continued

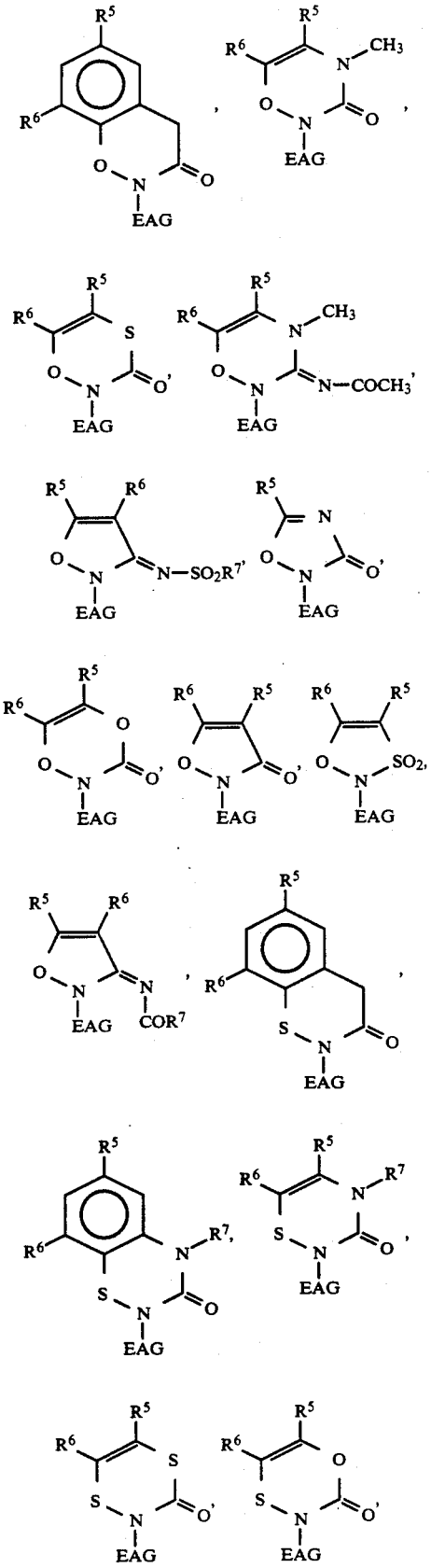

-continued

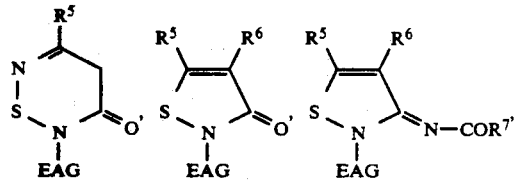

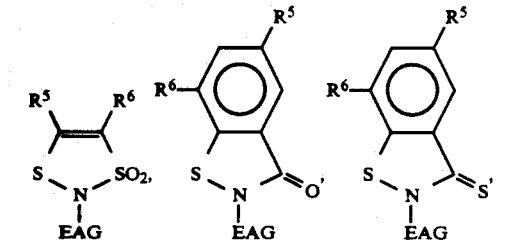

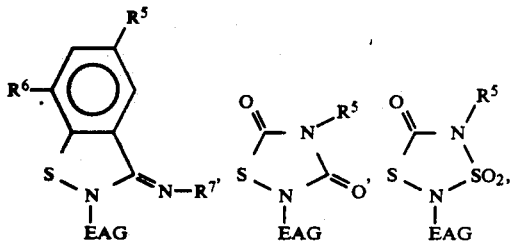

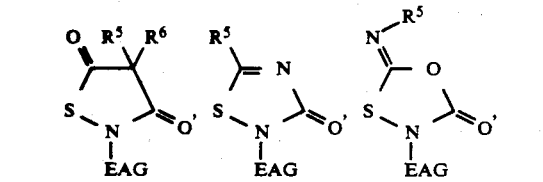

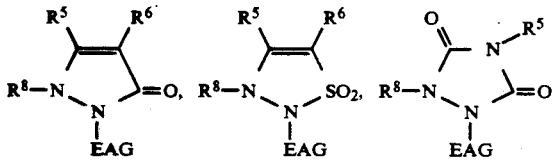

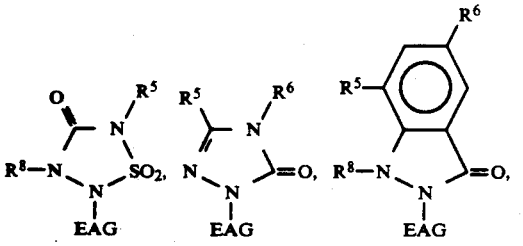

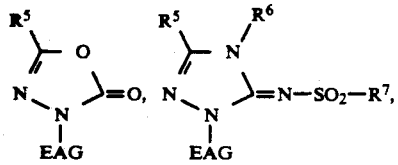

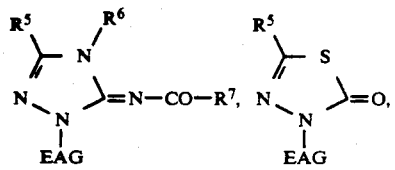

-continued

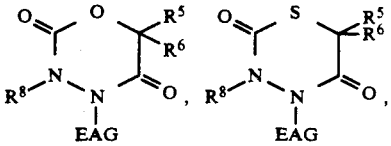

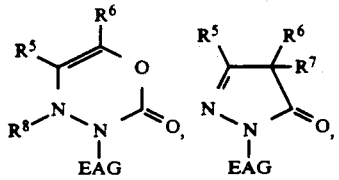

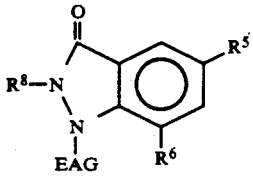

wherein $R^5$, $R^6$, $R^7$ and $R^8$, which may be the same or different, each represents a hydrogen atom or substituent groups. $R^5$, $R^6$ and $R^7$ preferably each represents a hydrogen atom, an alkyl group, an aryl group or a heterocyclic group and $R^8$ preferably represents an acyl group or a sulfonyl group.

Specifically, the groups for $R^1$ and $R^2$ described above is a preferred example as $R^5$ to $R^8$.

Especially preferred examples, of compounds represented by formula [III], including the bonding position for the —(Time)$_t$—PUG group, are indicated below. However the invention is not to be construed as being limited to these examples.

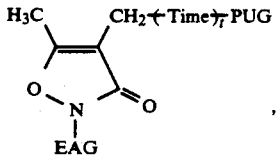

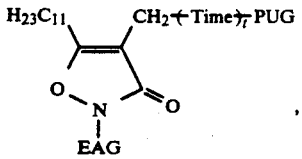

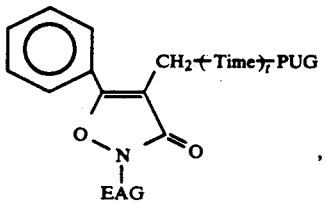

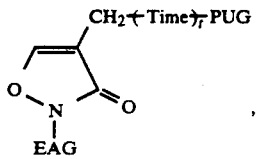

-continued
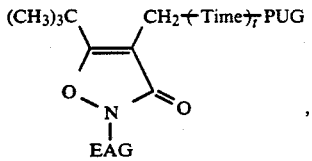
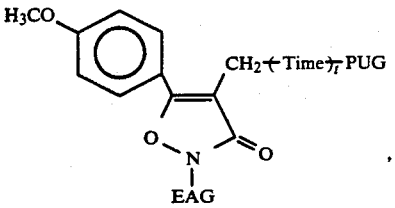
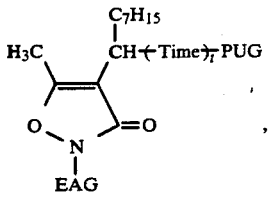
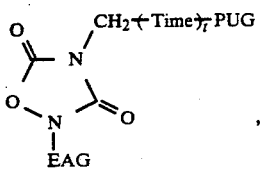
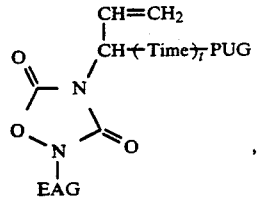
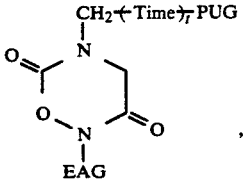
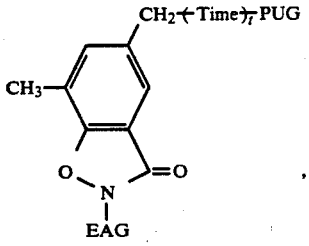
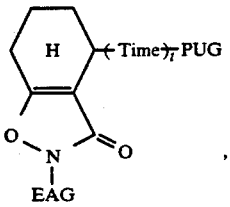
-continued
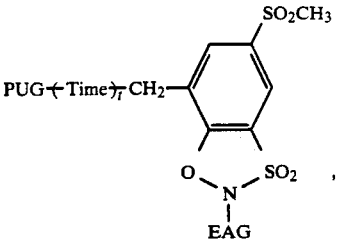
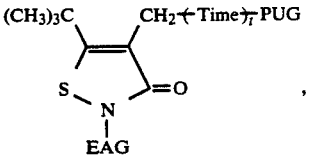
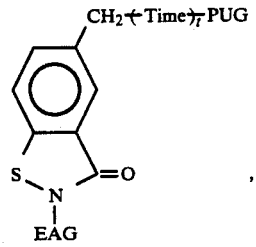
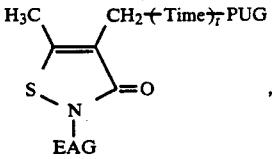
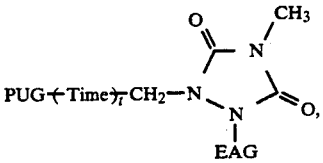
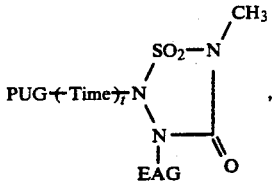
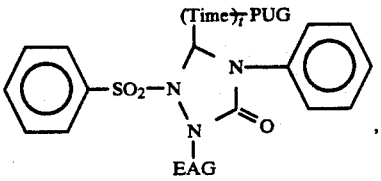
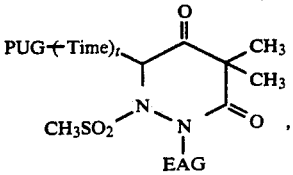

-continued

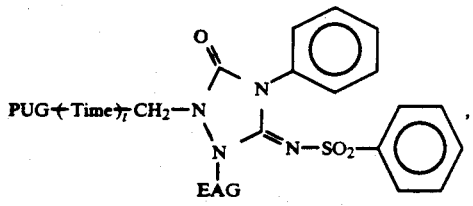

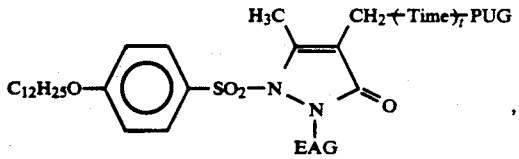

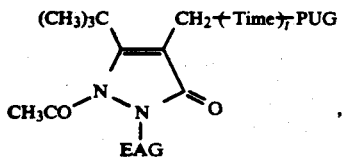

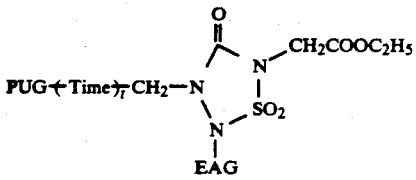

Specific compounds are described below in more detail.

EAG moiety in general formulae [II] and [III] is now described in greater detail.

The EAG represents an aromatic group which accepts electrons from a reducing substance, bonded to the nitrogen atom in general formulae [II] and [III]. Preferred EAG groups are represented by general formula [A]:

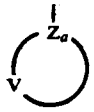

(A)

wherein $Z^1$ represents

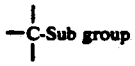

or a nitrogen atom, V represents an atomic group necessary for forming a three-membered to eight-membered aromatic ring together with $Z_1$, containing members selected from

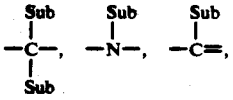

—N=, —O—, —S— and —$SO_2$—, wherein Sub represents a simple bond ($\pi$-bond), a hydrogen atom or a substituent group as indicated below, and plural Sub groups may be the same or different: provided that the sum of the para Hammett substituent constants, $\sigma_p$, of the substituent groups is at least +0.50, preferably at least +0.70 and most preferably at least +0.85; and further provided that at least two substituent groups may be linked to form a three-membered to eight-membered saturated or unsaturated carbocyclic or heterocyclic ring.

EAG represents a group which accepts electrons from a reducing substance and it is bonded to a nitrogen atom. EAG is preferably a heterocyclic group or an aryl group which is substituted with at least one electron attractive group. As the electron attractive group, it is particularly preferred to use a nitro atom, a trifluoromethyl group and a cyano group. The substituent groups which are bonded to the heterocyclic group or aryl group of the EAG can be used to adjust the properties of the compound as a whole. As well as controlling the ease with which an electron is accepted it is possible in this way to control properties such as, for example, water solubility, oil solubility, diffusion properties, sublimation properties, melting point, dispersibility in binders such as gelatin etc., reactivity with nucleophilic groups, reactivity with electrophilic groups, etc.

Specific examples of EAG are indicated below, but the present invention B not to be construed as being linked thereto.

Examples of EAG include an aryl group substituted with at least one electron attractive group, including a 4-nitrophenyl group, 2-nitrophenyl group, 2-nitro-4-N-methyl-N-n-butyl-sulfamoylphenyl group, 2-nitro-4-N-methyl-N-n-octyl-sulfamoylphenyl group, 2-nitro-4-N-methyl-n-dodecyl-sulfamoylphenyl group, 2-nitro-4-N-methyl N-hexadecylsulfamoylphenyl group, 2-nitro-4-N-methyl-N-n-octadecylsulfamoylphenyl group, 2-nitro-4-N-methyl N-(3-carboxypropyl)sulfamoylphenyl group, 2-nitro-4-N-ethyl-N-(2-sulfoethyl)sulfamoylphenyl group, 2-nitro-4-N-n-hexadecyl-N-(3-sulfopropyl)-sulfamoylphenyl group, 2-nitro-4-N-(2-cyanoethyl)-N-(2-hydroxyethoxy)ethyl)-sulfamoylphenyl group, 2-nitro-4-diethylsulfamoylphenyl group, 2-nitro-4-di-n-butylsulfamoylphenyl group, 2-nitro-4-di-n-octylsulfamoylphenyl group, 2-nitro-4-di-n-octadecylsulfamoylphenyl group, 2-nitro-4-methylsulfamoylphenyl group, 2-nitro-4-n-hexadecylsulfamoylphenyl group, 2-nitro-4-N-methyl-N-(4-dodecylsulfonylphenyl)sulfamoylphenyl group, 2-nitro-4-(3-methylsulfamoylphenyl)sulfamoylphenyl group, 4-nitro-2-N-methyl-N-n butylsulfamoylphenyl group, 4 nitro-2-N-methyl-N-n-octylsulfamoylphenyl group, 4-nitro-2-N-methyl-N-n-dodecylsulfamoylphenyl group, 4-nitro-2-N-methyl-N-n-hexadecylsulfamoylphenyl group, 4-nitro-2-N-methyl-N-n-octadecylsulfamoyl group, 4-nitro-2-N-methyl-N-(3-carboxypropyl)sulfamoylphenyl group, 4-nitro-2-N-ethyl-N-(2-sulfoethyl)sulfamoylphenyl group, 4-nitro-2-N-n-hexadecyl-N-(3-sulfopropyl)sulfamoylphenyl group, 4-nitro-2-N-(2-cyanoethyl)-N-((2-hydroxyethoxy)ethyl)sulfamoylphenyl group, 4-nitro-2-diethylsulfamoylphenyl group, 4-nitro-2-di-n-butylsulfamoylphenyl group, 4-nitro-2-di-n-octylsulfamoylphenyl group, 4-nitro-2-di-n-octadecylsulfamoylphenyl group, 4-nitro-2-methylsulfamoylphenyl group, 4-nitro-2-n-hexadecylsulfamoylphenyl group, 4-nitro-2-N-methyl-N-(4-dodecylsulfonylphenyl)sulfamoylphenyl group, 4-nitro-2-(3-methylsulfamoylphenyl)sulfamoylphenyl group, 4-nitro-2-chlorophenyl group, 2-nitro-4-chlorophenyl group, 2-nitro-4-N-methyl-N-n-butylcarbamoylphenyl group, 2-nitro 4-N-methyl-N-n-octylcarbamoylphenyl group, 2-nitro-4-N-methyl-N-n-dodecylcarbamoylphenyl group, 2-nitro-4-N-methol-N-n-hexadecylcarbamoylphenyl group, 2-nitro-4-N-methyl-N-n-octadecylcarbamoylphenyl group, 2-nitro-4-N-methyl-N-(3-carboxypropyl)carbamoylphenyl group, 2-nitro 4-N-ethyl-N-(2-sulfoethyl)carbamoylphenyl group, 2-nitro-4-N-n-hexadecyl-N-(3-sulfopropyl)carbamoylphenyl group 2-nitro-4-N-(2-cyanoethyl)-N-((2-hydroxyethoxy)ethyl)carbamoylphenyl group, 2-nitro-4-diethylcarbamoylphenyl group, 2-nitro-4-di-n-butylcarbamoylphenyl group, 2-nitro-4-di-n-octyl-carbamoylphenyl group, 2-nitro-4-di-n-octadecylcarbamoylphenyl group, 2-nitro-4-methylcarbamoylphenyl group, 2-nitro-4-n-hexadecylcarbamoylphenyl group, 2-nitro-4-N-methyl-N-(4-dodecylsulfonylphenyl)carbamoylphenyl group, 2-nitro-4-(3-methylsulfamoylphenyl)carbamoylphenyl group, 4-nitro-2-N-methyl-N-n-butylcarbamoylphenyl group, 4-nitro-2-N-methyl-N-n-octylcarbamoylphenyl group, 4-nitro-2-N-methyl-N-dodecylcarbamoylphenyl group, 4-nito-2-N-methyl-N-n-hexadecylcarbamoylphenyl group, 4-nitro-2-N-methyl-N-n-octadecylcarbamoylphenyl group, 4-nitro-2-N-methyl-N-(3-carboxypropyl)carbamoylphenyl group, 4-nitro-2-N-ethyl-N-(2-sulfoethyl)carbamoylphenyl group, 4-nitro-2-N-n-hexadecyl-N-(3-sulfopropyl)carbamoylphenyl group, 4-nitro-2-N- (2-cyanoethyl)-N-((2-hydroxyethoty)ethyl)-carbamoylphenyl group, 4-nitro-2-diethylcarbamoylphenyl group, 4-nitro-2-di-n-butylcarbamoylphenyl group, 4-nitro-2-di-n-octylcarbamoylphenyl group, 4-nitro-2-di-n-octadecylcarbamoylphenyl group 4-nitro-2-methylcarbamoylphenyl group, 4-nitro-2-n-hexadecylcarbamoylphenyl group, 4-nitro-2-N-methyl-N-(4-dodecylsulfonylphenyl)-carbamoylphenyl group, 4-nitro-2-(3-methylsulfamoylphenyl)carbamoylphenyl group, 2,4-dimethanesulfonylphenylgroup, 2-methanesulfonyl-4-benzenesulfonylphenyl group, 2-n-octanesulfonyl-4-methanesulfonylphenyl group, 2-n-tetradecanesulfonyl-4-methanesulfonylphenyl group, 2-n-hexadecanesulfonyl-4-methanesulfonylphenyl group, 2,4-di-n-dodecanesulfonylphenyl group, 2,4-didodecanesulfonyl-5-trifluoromethylphenyl group, 2-n-decanesulfonyl-4-cyano-5-trifluoromethylphenyl group, 2-cyano-4-methanesulfonylphenyl group, 2,4,6-tricyanophenyl group, 2,4-dicyanophenyl group, 2-nitro-4-methanesulfonylphenyl group, 2-nitro-4-n-dodecanesulfonylphenyl group, 2-nitro-4-(2 -sulfoethylsulfonyl)phenyl group, 2-nitro-4 carboxymethyl sulfonylphenyl group, 2-nitro-4-carboxyphenyl group, 2-nitro-4-ethoxycarbonyl-5-n-butoxyphenyl group, 2 nitro-4-ethoxycarbonyl-5-n-hexadecyloxyphenyl group, 2-nitro-4-diethylcarbamoyl-5-n-hexadecyloxyphenyl group, 2-nitro-4-cyano-5-n-dodecylphenyl group, 2,4-dinitrophenyl group, 2-nitro-4-n-decylthiophenyl group, 3,5-dinitrophenyl group, 2-nitro-3,5-dimethyl-4-n-hexadecanesulfonylphenyl group, 4-methanesulfonyl-2-benzenesulfonylphenyl group, 4-n- octanesulfonyl-2-methanesulfonylphenyl group, 4-n-tetradecanesulfonyl-2-methanesulfonylphenyl group, 4-n-hexadecanesulfonyl-2-methanesulfonylphenyl group, 2,5-di-dodecanesulfonyl-4-trifluoromethylphenyl group, 4-n-decanesulfonyl-2-cyano-5-trifluoromethylphenyl group, 4-cyano-2-methanesulfonylphenyl group, 4-nitro-2-methanesulfonylphenyl group, 4-nitro- 2-n-dodecanesulfonylphenyl group, 4-nitro-2-(2-sulfoethylsulfonyl)phenyl group, 4-nitro-2-carbaxymethylsulfonylphenyl group, 4-nitro-2 -carboxyphenyl group, 4-nitro-2-ethoxycarbonyl-5-n-butoxy-phenyl group, 4-nitro 2-ethoxycarbonyl-5-n-hexadecyloxyphenyl group, 4-nitro-2-diethylcarbamoyl-5-n-hexadecyloxy-phenyl group, 4-nitro-2-cyano-5-n-dodecylphenyl group, 4-nitro-2-n-decylthiophenyl group, 4-nitro-3,5-dimethyl-2-n-hexadecanesulfonylphenyl group, 4-nitronaphthyl group, 2,4-dinitronaphthyl group, 4-nitro-2-n-octadecylcarbamoyl-naphthyl group, 4-nitro-2-dioctylcarbamoyl-5-(3-sulfobenzenesulfonylamino)naphthyl group, 2,3,4,5,6-pentafluorophenyl group, 2-nitro-4-benzoylphenyl group, 2,4-diacetylphenyl group, 2-nitro-4-trifluoromethylphenyl group, 4-nitro-2-trifluoromethylphenyl group, 4-nitro-3-trifluoromethylphenyl group, 2,4,5-tricyanophenyl group, 3,4-dicyanophenyl group, 2-chloro-4,5-dicyanophenyl group, 2-bromo-4,5-dicyanophenyl group, 4-methanesulfonylphenyl group, 4-n-hexadecanesulfonylphenyl group, 2-decane-sulfonyl-5-trifluoromethylphenyl group, 2-nitro-5-methylphenyl group, 2-nitro-5-n-octadecyloxyphenyl group, 2-nitro 4-N-(vinylsulfonylethyl)-N-methylsulfamoylphenyl group, 2-methyl-6-nitro-benzoxazol-5-yl group, etc.

Examples of heterocyclic groups represented by EAG include, for example, a 2-pyridyl group, 3-pyridyl group, 4-pyridyl group, 5-nitro-2-pyridyl group, 5-nitro-N-hexadecylcarbamoyl-2-pyridyl group, 3,5-dicyano-2-pyridyl group, 5-dodecanesulfonyl-2-pyridyl group, 5-cyano-2-pyridyl group, 4-nitrothiophene-2-yl group, 5-nitro-1,2-dimethylimidazol-4-yl group, 3,5-diacetyl 2-pyridyl group, 1-dodecyl-5-carbamoylpyridinium-2-yl group, 5-nitro-2-furyl group, 5-nitrobenzthiazol-2-yl group, etc.

The —(Time)$_t$—PUG group is now described in greater detail.

Time represents a group which releases a PUG after cleavage of the bond between PWR and —(Time)$_t$—PUG, in a later reaction which is triggered by the cleavage of a nitrogen-oxygen, nitrogen-nitrogen or a nitrogen-sulfur bond. Various conventional groups are represented by Time, including for example those disclosed on pages 5 and 6 of Japanese Pat. application (OPI) No. 147244/86, pages 8 to 14 of Japanese Pat. application (OPI) No. 23549/86 and pages 36 to 44 of Japanese Pat. application (OPI) No. 21527087, and pages 9 to 22 of European Pat. No. 220746.

PUG represents a group which is photographically useful as Time-PUG or PUG. Photographically useful groups include for example development inhibitors, development accelerators, nucleating agents, silver halide solvents, competive compounds, developing agents, auxiliary developing agent, silver halide dissolution accelerators, silver halide dissolution inhibitors, toning agents, image stabilizers, ultraviolet absorbers, nucleation accelerators, etc., and precursors thereof.

There are also photographically useful compounds which have overlapping functions in terms of usefulness and these cannot be classified unreservedly in terms of their function. Typical examples include those disclosed Japanese Pat. application (OPI) No. 215272/87.

Some typical examples of photographically useful groups for use in this invention are described below, but the present invention is not to be construed as being limited thereto.

Examples of compounds which can be added as development inhibitors include azoles, for examples, benzothiazolium salts, nitroindazoles, triazoles, benzotriazoles, benzimidazoles (especially nitro or halogen substituted derivatives) and phenylmercaptoimidazoles;

heterocyclic mercapto compounds, for example, mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines; these heterocyclic mercapto compounds substituted water solubilizing groups such as carboxyl groups and sulfo groups etc.; thioketo compounds, for example, oxazolinethione; azaindenese, for example, tetra-azaindenes (especially 4-hydroxy substituted (1,3,3*a*,7)tetra-azaindenes); benzenethiosulfonic acids; benzenesulfinic acids; and many compounds which are known as anti-fogging agents or stabilizers, including organic oxidizing agents such as the phenazines, anthraquinones, N-halogen compounds, etc.

The following compounds, selected from among the above mentioned compounds, are especially preferred: substituted or unsubstituted mercaptoazoles (specific examples include 1-phenyl-5-mercaptotetrazole, 1-(4-carboxyphenyl)-5-mercaptotetrazole, 1-(3-hydroxyphenyl)-5-mercaptotetrazole, 1-(4-sulfonylphenyl)-5-mercaptotetrazole, 1-(3-sulfophenyl)-5-mercaptotetrazole, 1-(4-sulfamoylphenyl)-5-mercaptotetrazole, 1-(3-hexanoylaminophenyl)-5-mercaptotetrazole, 1-ethyl-5-mercaptotetrazole, 1-(2-carboxyethyl)-5-mercaptotetrazole, 2-methylthio-5-mercapto-1,3,4-thiadiazole, 2-(2-carboxyethylthio)-5-mercapto-1,3,4-thiadiazole, 3-methyl-4-phenyl-5-mercapto-1,2,4-triazole, 2-(2-dimethylaminoethylthio)-5-mercapto-1,3,4-thiadiazole, 1-(4-n-hexylcarbamoylphenyl)-2-mercaptoimidazole, 3-acetylamino-4-methyl-5-mercapto-1,2,4-triazole, 2-mercaptobenzoxazole, 2-mercaptobenzimidazole, 2-mercapto-6-nitro-1,3-benzoxazole, 1-(1-naphthyl)-5-mercaptotetrazole, 2-phenyl-5-mercapto-1,3,4-oxadiazole, 1-{3-(3-methylureido)phenyl}-5-mercaptotetrazole, 1-(4-nitrophenyl)-5-mercaptotetrazole, 5-(2-ethylhexanoylamino)-2-mercaptobenzimidazole etc.), substituted or unsubstituted mercaptoazaindenes (specific examples include 6-methyl-4-mercapto-1,3,3*a*,7-tetraazaindene, 6-methyl-2-benzyl-4-mercapto-1,3,3*a*,7-tetraazaindene, 6-phenyl-4-mercaptotetraazaindene, 4,6-dimethyl-2-mercapto-1,3,3*a*,7-tetraazaindene etc,), substituted or unsubstituted mercaptopyrimidines (specific examples include 2-mercaptopyrimidine, 2-mercapto-4-methyl-6-hydroxypyrimidine, 2-mercapto-4-propylpyrimidine etc.), heterocyclic compounds which can form iminosilver, for example, substituted or unsubstituted benzotriazoles (specific examples include benzotriazole, 5-nitrobenzotriazole, 5-methylbenzotriazole, 5,6-dichlorobenzotriazole, 5-bromobenzotriazole, 5-methoxybenzotriazole, 5-acetylaminobenzotriazole, 5-n-butylbenzotriazole, 5-nitro-6-chlorobenzotriazole, 5,6-dimethylbenzotriazole, 4,5,6,7-tetrachlorobenzotriazole etc.), substituted or unsubstituted indazoles (specific examples include imidazole, 5-nitroindazole, 3-nitroindazole, 5-chloro-5-nitroindazole, 3-cyanoindazole, 3-n-butylcarbamoylindazole, 5-nitro-3-methanesulfonylindazole etc.) and substituted or unsubstituted benzimidazoles (specific examples include 5-nitrobenzimidazole, 4-nitrobenzimidazole, 5,6-dichlorobenzimidazole, 5-cyano-6-chlorobenzimidazole, 5-trifluoromethyl-6-chlorobenzimidazole etc.), etc.

In the case of the development inhibitors, the compounds which have development inhibiting properties are formed after release from the redox parent nucleus of general formula [I] by means of a reaction following the redox reaction in the development process, and subsequently these compounds may be converted to compounds which have essentially no development inhibiting properties at all or greatly reduced development inhibiting properties. Specific examples include 1-(3-phenoxycarbonylphenyl)-5-mercaptotetrazole, 1-(4-phenoxycarbonylphenyl)-5-mercaptotetrazole, 1-(3-maleimidophenyl)-5-mercaptotetrazole, 5-(phenoxycarbonyl)benzotriazole, 5-(p-cyanophenoxycarbonyl)benzotriazole, 2-phenoxycarbonylmethylthio-5-mercapto-1,3,4-thiadiazole, 5-nitro-3-phenoxycarbonylindazole, 5-phenoxycarbonyl-2-mercaptobenzimidazole, 5-(2,3-dichloropropyloxycarbonyl)-benzotriazole, 5-benzyloxycarbonylbenzotriazole, 5-(butylcarbamoylmethoxycarbonyl)benzotriazole, 5-(butoxycarbonylmethoxycarbonyl)benzotriazole, 1-(4-benzoyloxyphenyl)-5-mercaptotetrazole, 5-(2-methanesulfonylethoxycarbonyl)-2-mercaptobenzothiazole, 1-{4-(2-chloroethoxycarbonyl)-phenyl}-2-mercaptoimidazole, 2-[3-{thiophene-2-yl-carbonyl}propyl]thio-5-mercapto-1,3,4-thiadiazole, 5-cinnamoylaminobenzotriazole, 1-(3-vinylcarbonylphenyl)-5-mercaptotetrazole, 5-succinimidomethylbenzotriazole, 2-{4-succinimidophenyl}-5-mercapto-1,3,4-oxadiazole, 3-{4-(benzo-1,2-isothizol-3-oxo-1,1-dioxy-2-yl)phenyl}-5-mercapto-4-methyl-1,2,4-triazole, 6-phenoxycarbonyl-2-mercaptobenzoxazole, etc.

Examples of compounds in which PUG is a development accelerator include amine based compounds, imidazole based compounds, imidazoline based compounds, phosphonium based compounds, sulfonium based compounds, hydrazine based compounds thioether based compounds, thione based compounds, certain types of mercapto compounds, mesoionic compounds and thiocyanates, etc.

Useful amino compounds include both inorganic amines, such as hydroxylamine, and organic amines. The organic amines include aliphatic amines, aromatic amines, cyclic amines, mixed aliphatic-aromatic amines and heterocyclic amines and primary, secondary and tertiary amines and quaternary ammonium salts are all effective.

Specific examples of useful amine compounds are disclosed in Japanese Patent Application (OPI) No. 06244/81, Japanese Patent Publication No. 23465/65, U.S. Pat. Nos. 3,128,182, 2,496,903, 3,128,183, 3,253,919, 2,482,846 and 2,541,889, Japanese Patent Publication Nos. 16590/69 and 4552/71, Japanese Patent Application (OPI) No. 140340/75, U.S. Pat. No. 3,017,271, British Patent No. 1,098,748, Japanese Patent Application (OPI) Nos. 43429/77 and 137726/75 Japanese Patent Publication Nos. 30074/69 and 137726/75, Japanese Patent Application (OPI) Nos. 5335/74, 114328/77, 121321/77, 44025/78 and 156826/81, U.S. Pat. Nos. 2,518,698, 2,521,925, 2,743,182, 2,461,919, 3,578,454 and 3,523,796, Japanese Patent Application (OPI) Nos. 69613/77 and 11837/85, U.S. Pat. Nos. 2,288,226 and 2,271,623, etc.

The compounds disclosed in Japanese Patent Publication Nos. 45541/72 and 30502/73, and Japanese Patent Application (OPI) No. 54333/83 are examples of useful imidazole based compounds, and examples of imidazoline based compounds are disclosed in Japanese Patent Publication No. 12380/78 and U.S. Pat. No. 2,892,713.

Furthermore it has long been known that hydrazine compounds accelerate development, as disclosed in U.S. Pat. Nos. 3,730,727, 3,227,552, 3,386,831 and 2,419,975, in Mees, *The Theory of Photographic Process*, page 281 (3rd ed., 1966), U.S. Pat. Nos. 4,224,401, 4,168,977, 4,243,739, 4,272,614, 4,323,643, 4,385,108 and 4,269,929 and these compounds are also included in the scope of the present invention.

Furthermore the thioether based compounds, thione based compounds, certain types of mercapto based compounds and mesoionic compounds include conventional silver halide solvents.

Examples of compounds in which PUG is a nucleating agent include the part of the eliminated group which is released from the coupler which is disclosed in Japanese Patent Application (OPI) No. 170840/84.

However, all conventional compounds capable of forming nuclei in internal latent image type silver halides can be used as nucleating agents in the present invention and combinations of two or more types of nucleating agent can also be used for the nucleating agent. More precisely the substances disclosed for example in *Research Disclosure* No. 22,534 (published January 1983, pages 50 to 54), 15,162 (published November 1976, pages 76 to 77) and 23,510 (published November 1983, pages 346 to 352) can be used as nucleating agents, including quaternary heterocyclic compounds and hydrazine based compounds.

Japanese Patent Application (OPI) No. 230135/86 and U.S. Pat. No. 4,248,962 disclose other photographically useful groups.

Examples of cases in which PUG is a halide include bromide ions and iodide ions.

Examples of cases in which PUG is a silver halide solvent include the amine based compounds disclosed in Japanese Patent Publication No. 54661/85, the imidazole based compounds disclosed in Japanese Patent Application (OPI) No. 100717/79, the benzimidazole based compounds disclosed in Japanese Patent Publication No. 54662/85 and, moreover, sulfur containing compounds, for example thiocyanates, organic thioethers (for example the compounds disclosed in U.S. Pat. Nos. 3,574,628, 3,021,215, 3,057,724, 3,038,805, 4,276,374, 4,297,439 and 3,704,130, and Japanese Patent Application (OPI) No. 104926/82, etc.), thione compounds (for example the compounds disclosed in Japanese Patent Application (OPI) Nos. 82408/78 and 77737/80, U.S. Pat. No. 4,221,863, and Japanese Patent Application (OPI) No. 144319/78), the mesoionic compounds disclosed in Japanese Patent Application (OPI) No. 163042/85 and U.S. Pat. Nos. 4,003,910 and 4,378,424, etc., the mercaptoazoles and azolethiones which have an amino group as a substituent as disclosed in Japanese Patent Application (OPI) No. 202531/82, and the preferred compounds disclosed in Japanese Patent Application (OPI) No. 230135/86.

Moreover, the cyclic compounds disclosed in U.S. Pat. Nos. 2,857,274, 2,857,275 and 2,857,276 are also suitable and among these compounds uracil, urezole and 6-methyluracil, etc., are preferred.

Furthermore a selection can be made from among the disulfonylmethane compounds of U.S. Pat. Nos. 3,958,992, 3,976,647, 4,009,167, 4,032,538, 4,046,568, 4,047,954, 4,047,955 and 4,107,176 and Japanese Patent Application (OPI) No. 330/72, the dihydroxypyrimidine compounds which have thioether groups of U.S. Pat. Nos. 4,126,459, 4,150,228, 4,211,559 and 4,211,562, and the aminothioethers of U.S. Pat. Nos. 4,251,617, 4,267,254 and 4,267,256. These can be used individually or in combination and the use of two or more types of cyclic amido compound and hydroxypyrimidine compounds which have thioether groups is advantageous, since white crystals are not precipitated on the surface even on storing prints for long periods of time.

Examples of cases in which the PUG is an ultraviolet absorber include the compounds cited in section VIII-C of *Research Disclosure* 17643. The benzotriazole derivatives are preferred and these are disclosed in Japanese Patent Publication No. 29620/69, Japanese Patent Application (OPI) Nos. 151149/75 and 95233/79, U.S. Pat. No. 3,766,205, European Patent No. 00571560, and in Research Disclosure No. 22519, etc.

The compounds disclosed in U.S. Pat. Nos. 3,565,619, 3,607,269, 3,655,380, 3,687,660, 3,698,900, 3,704,126, 3,730,716, 3,756,825, 3,821,000, 3,936,401 and 4,279,983, British Patent 1,276,961, Japanese Patent Application (OPI) No. 43658/85 and West German Patent Application (OLS) 1,804,365 can be cited as image stabilizers.

Examples of cases in which the PUG is a toning agent include a tetrahydropyrimidinethione derivative and a 3-mercapto-1,2,4-triazole derivative, desclosed in U.S. Pat. Nos. 3,756,825 and 4,526,857, etc.

Specific examples of compounds of general formula [I] which can be used in the invention are listed below, but the invention is not to be construed as being limited to these compounds.

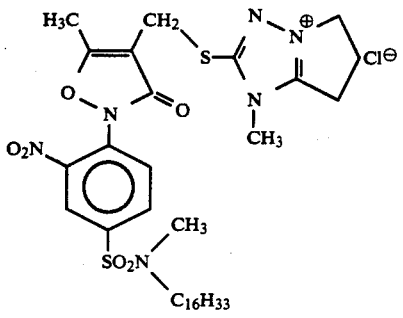

1

-continued
2
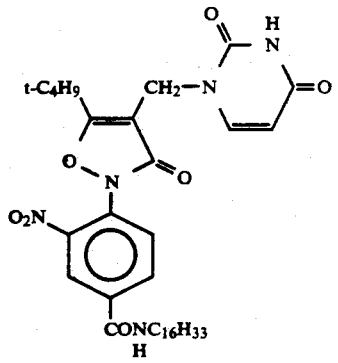
3
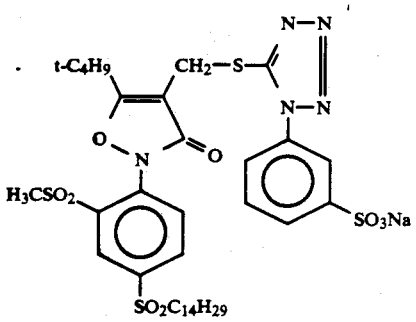
4
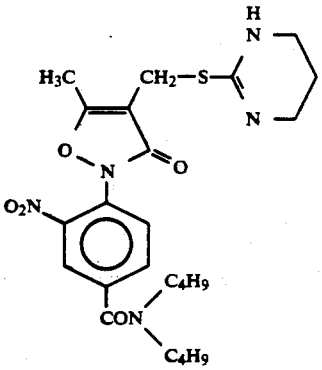
5
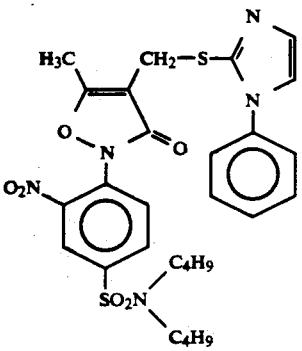

-continued
6
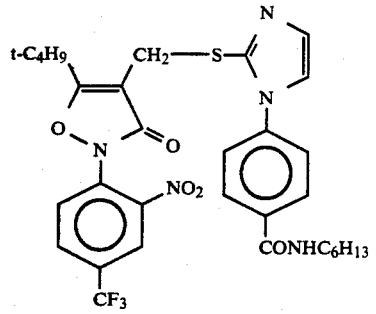
7
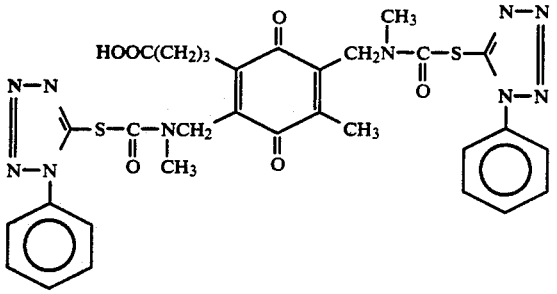
8.
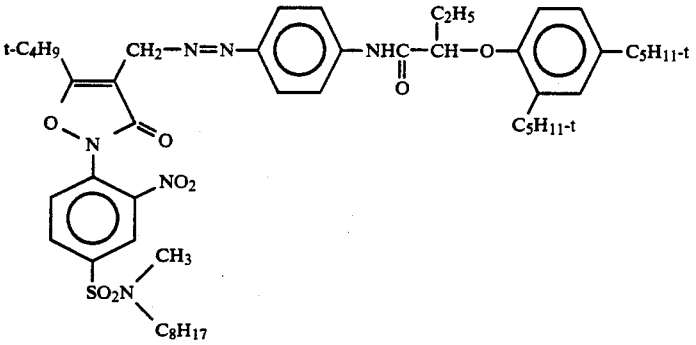
9.
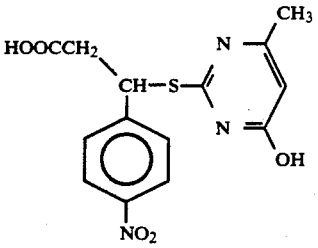
10.
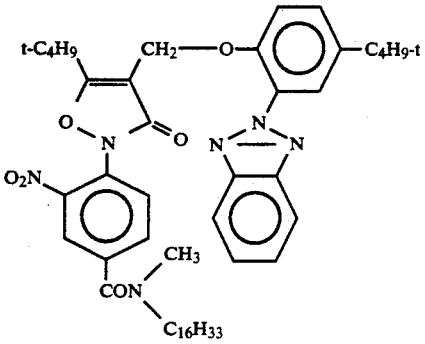

-continued
11.
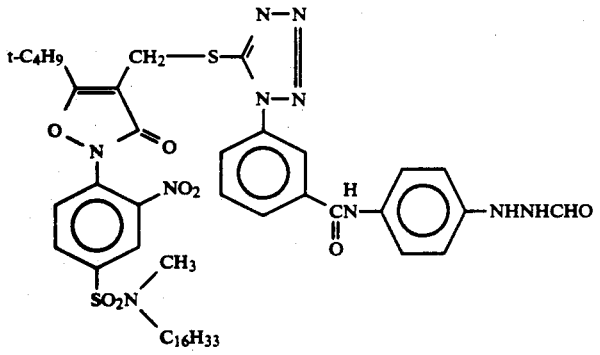
12.
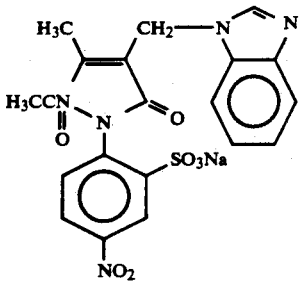
13.
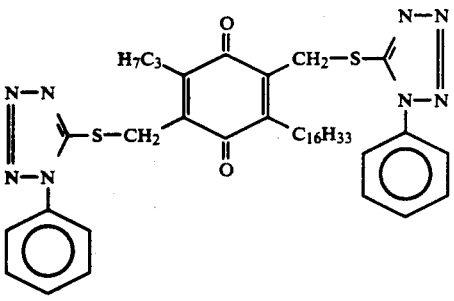
14.
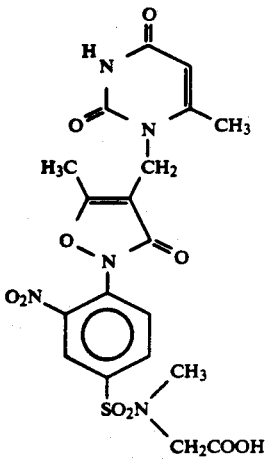

-continued
15.
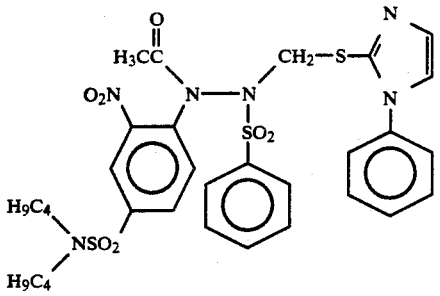
16.
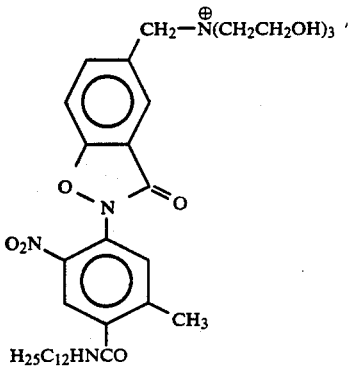
17.
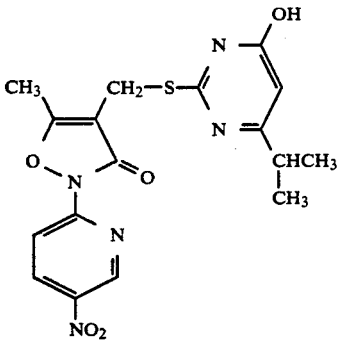
18.
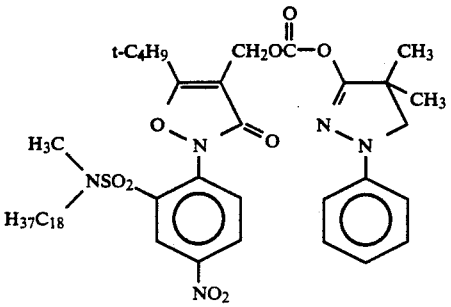

-continued
19.
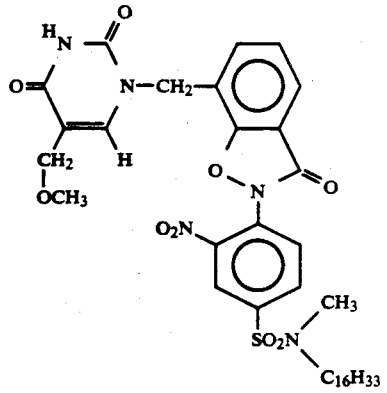
20.
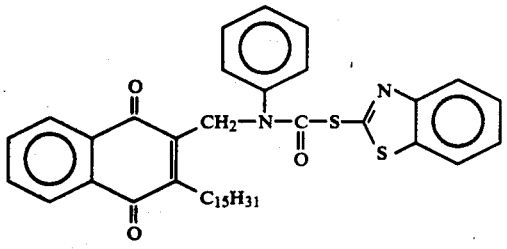
21.
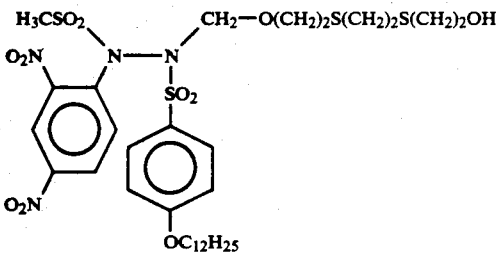
22.
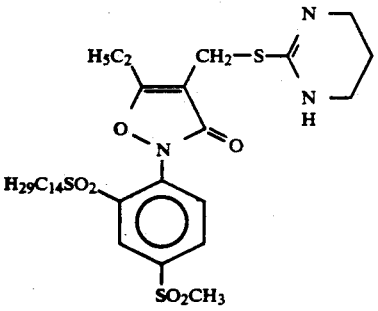
23.
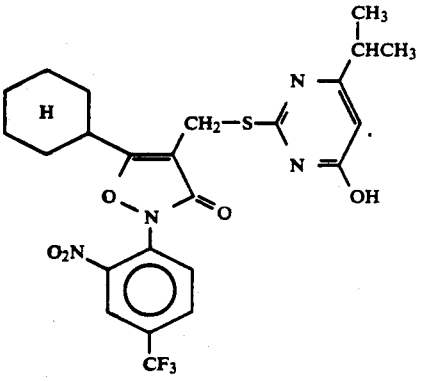

-continued
24.
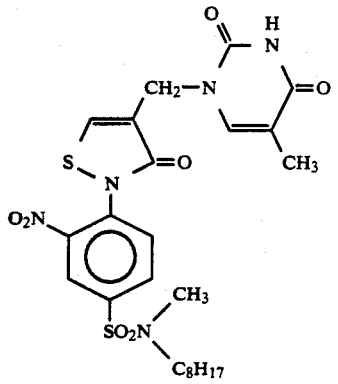
25.
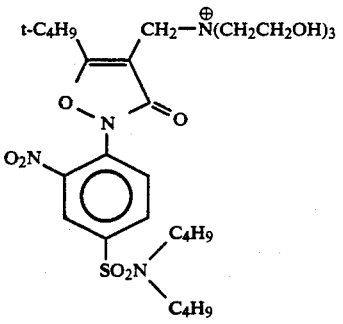
26.
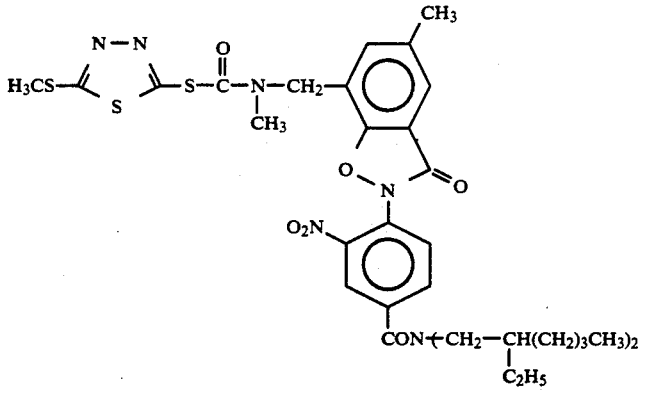
27.
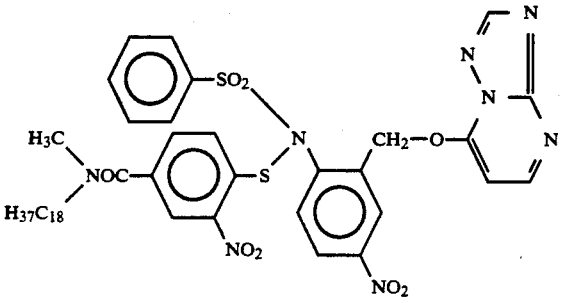

-continued
28.
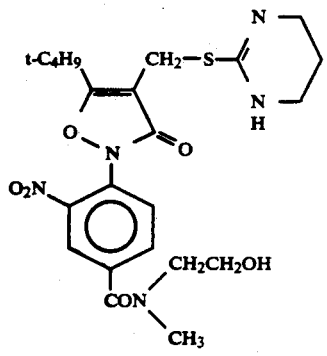
29.
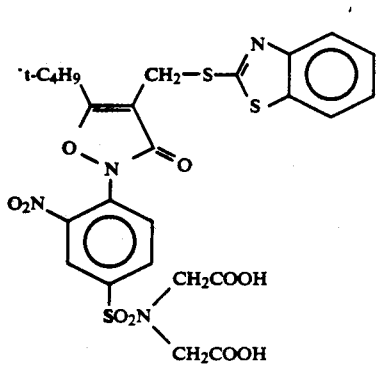
30.
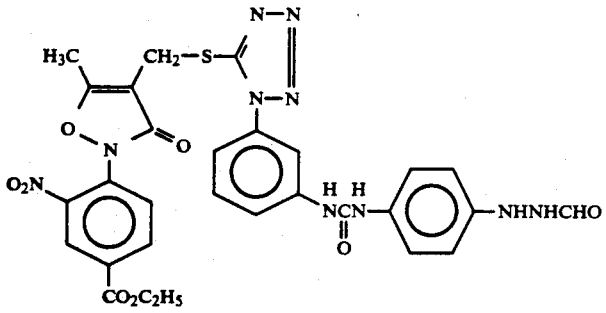
31.
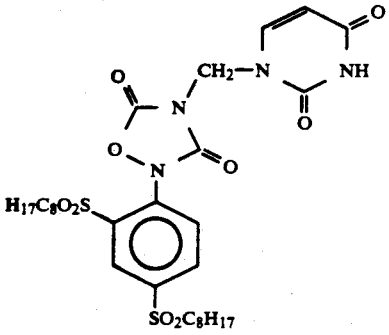

-continued
32.
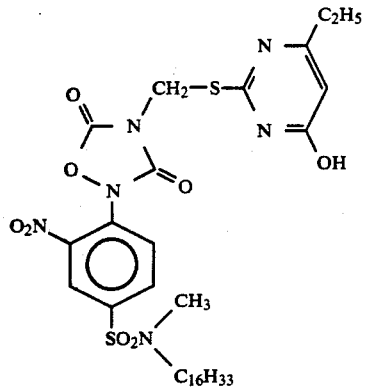
33.
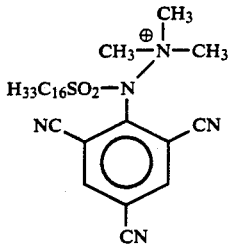
34.
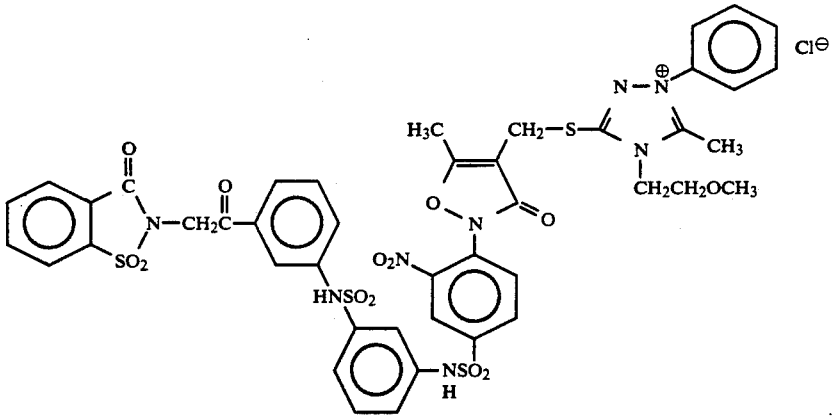
35.
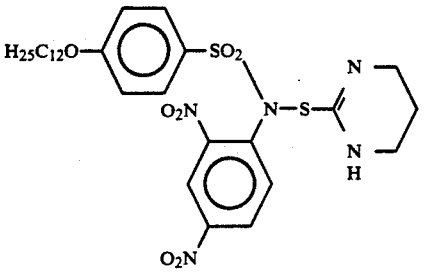

-continued
36.
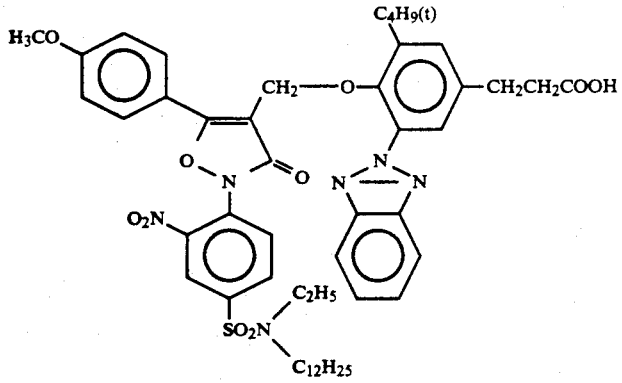
37.
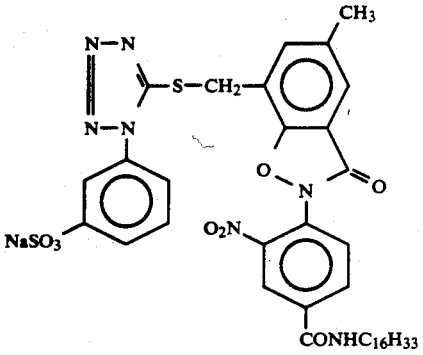
38.
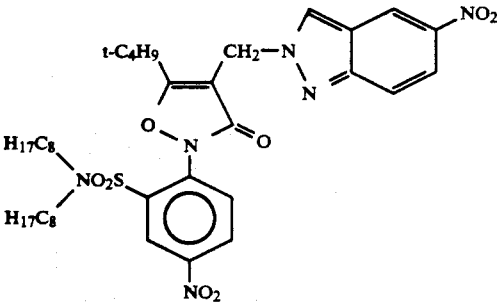
39.
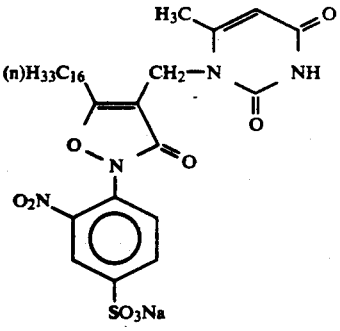
40.
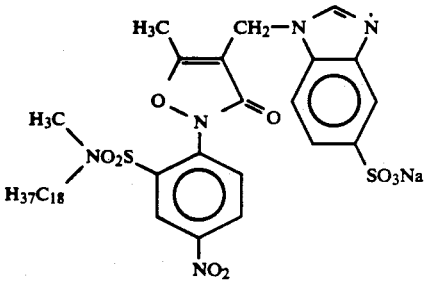

-continued
41.
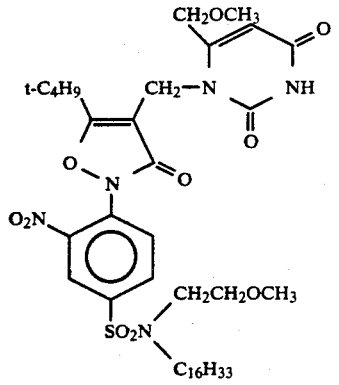
42.
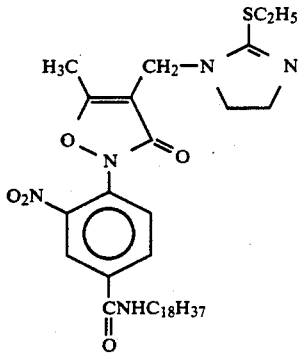
43.
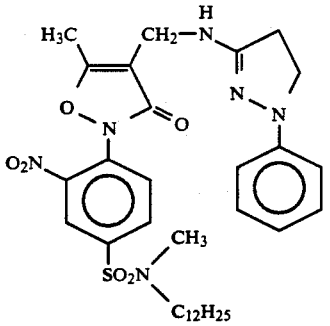
44.
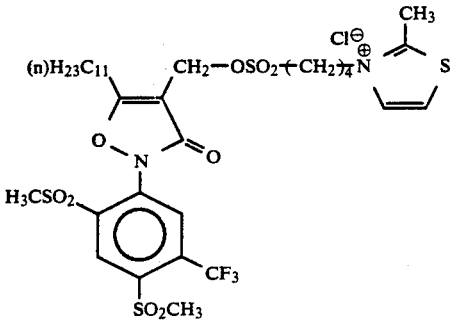

-continued
45.
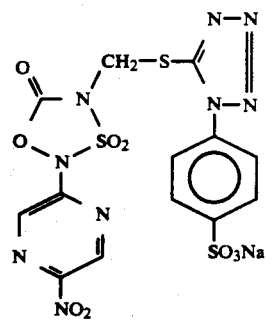
46.
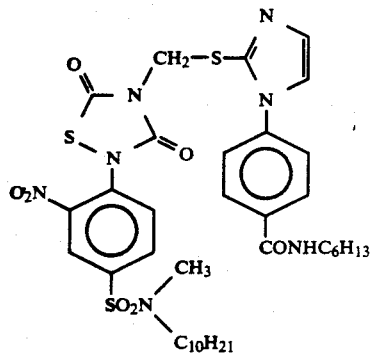
47.
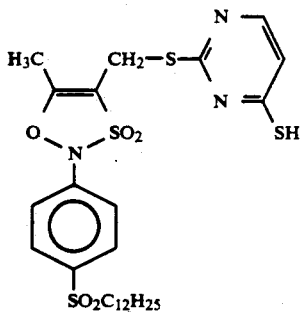
48.
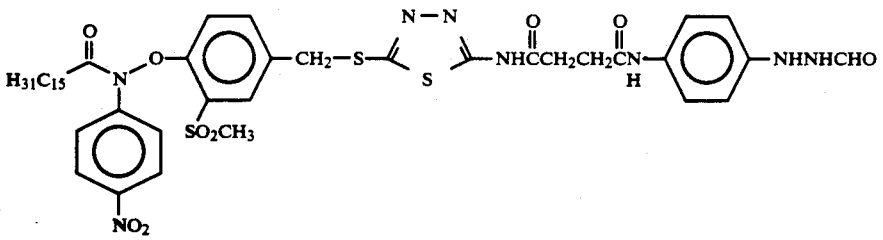
49.
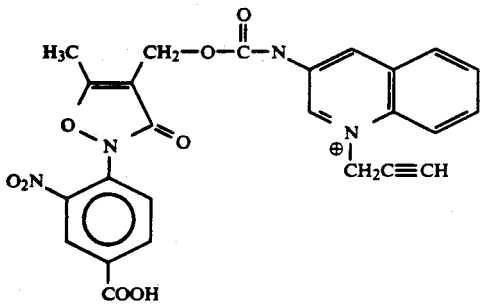

-continued
50.
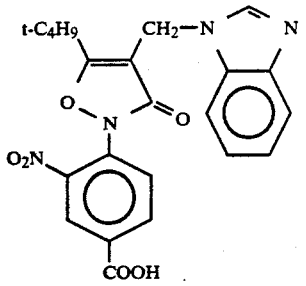
51.
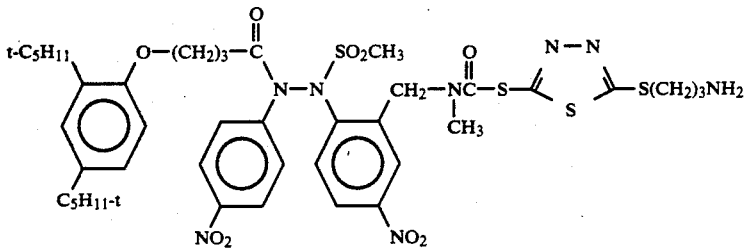
52.
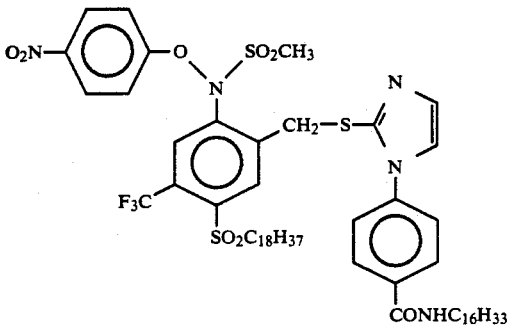
53.
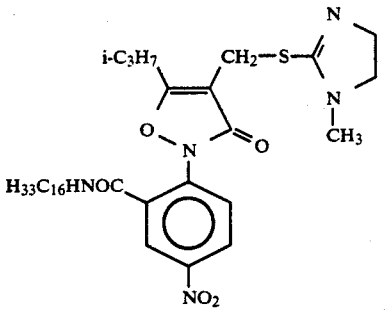
54.
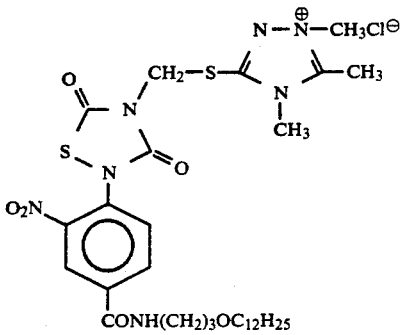

-continued
55.
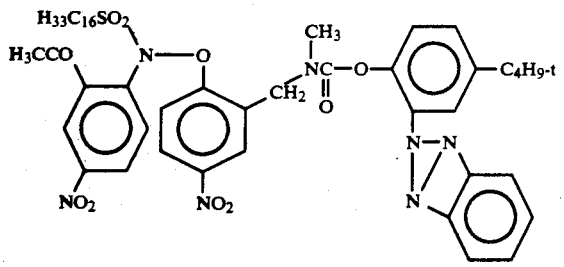
56.
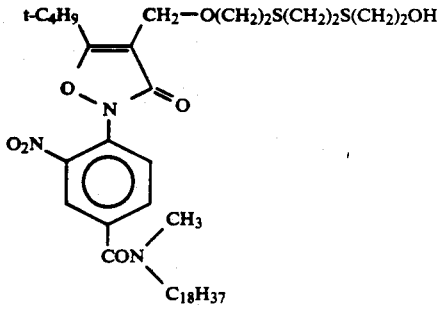
57.
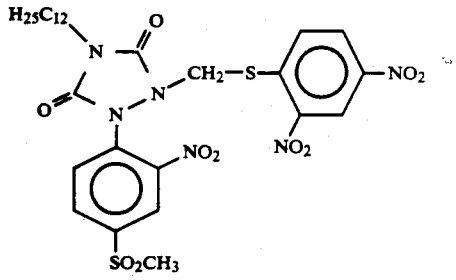
58.
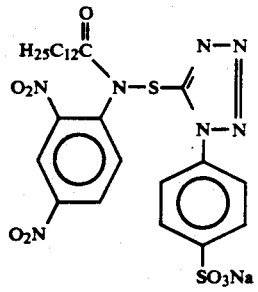
59.
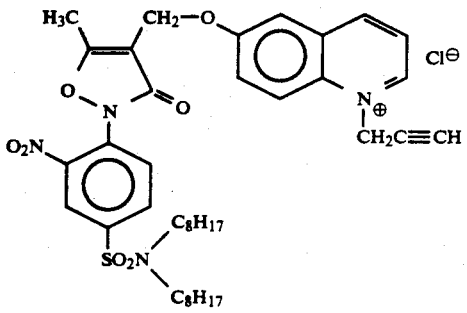

-continued
60.
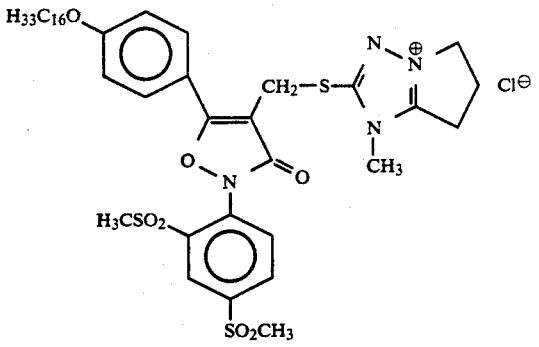
61.
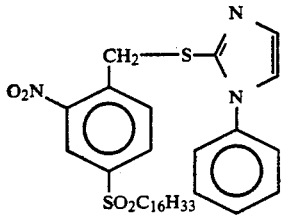
62.
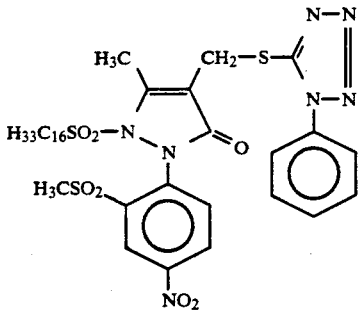
63.
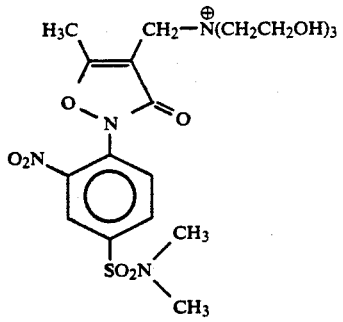
64.
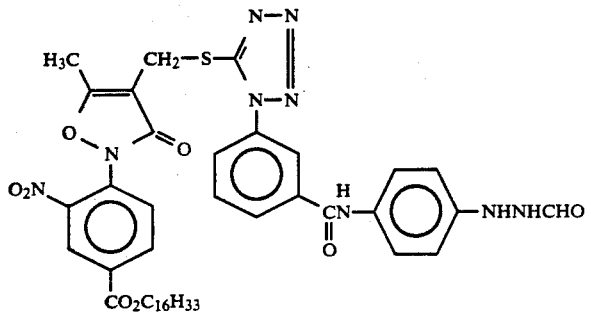

-continued
65.
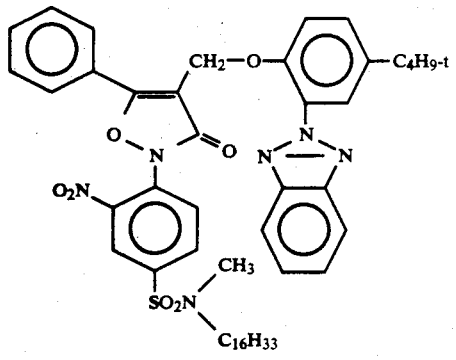
66.
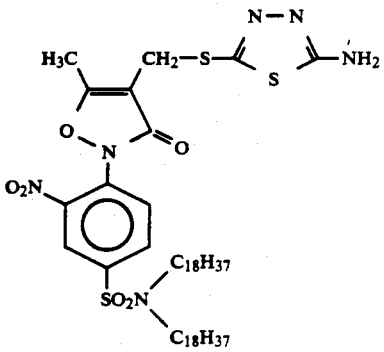
67.
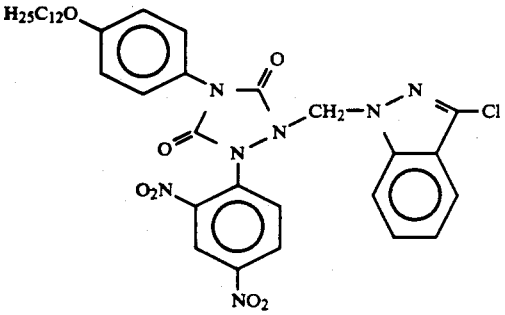
68.
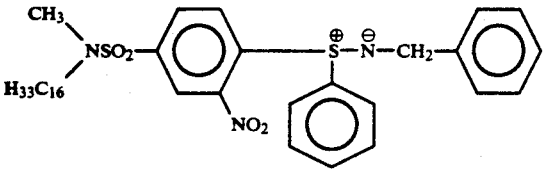
69.
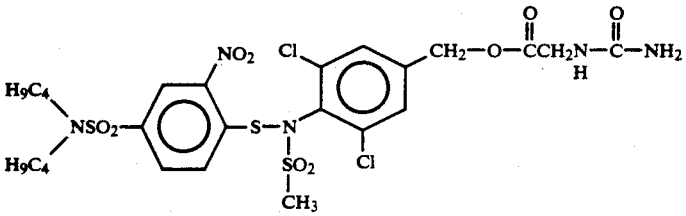

-continued
70.
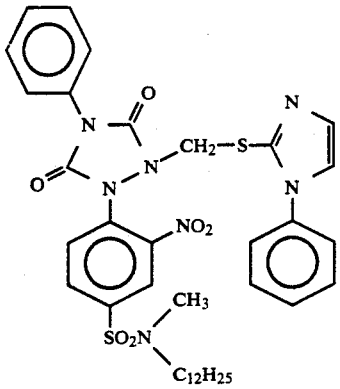
71.
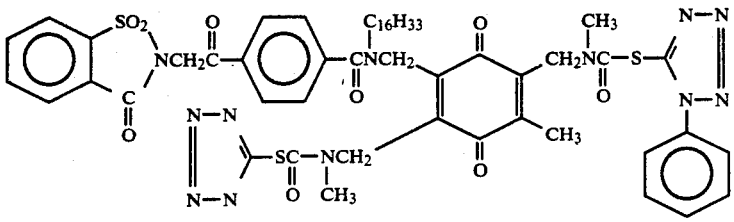
72.
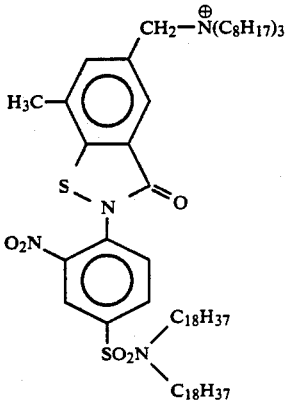
73.
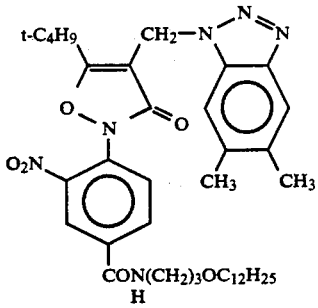
74.
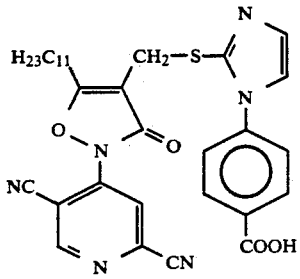

-continued
75.
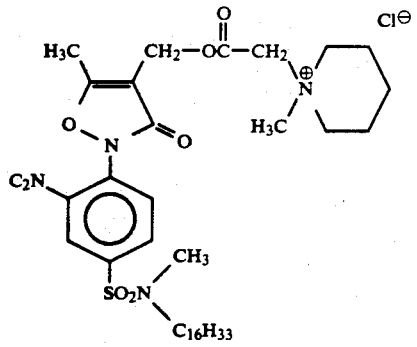
76.
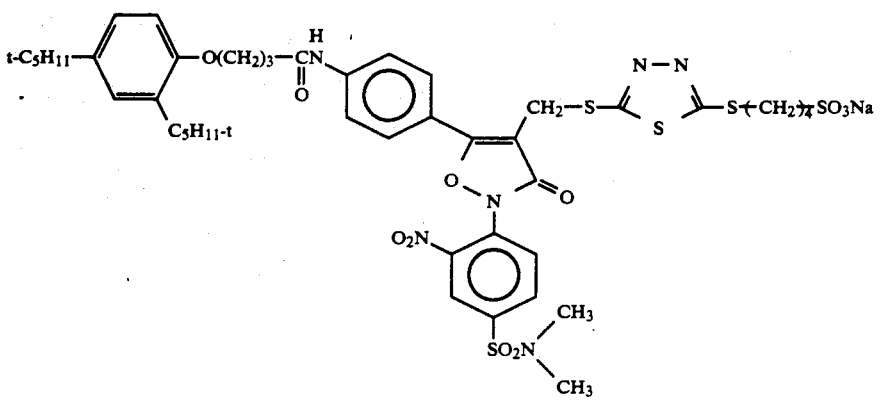
77.
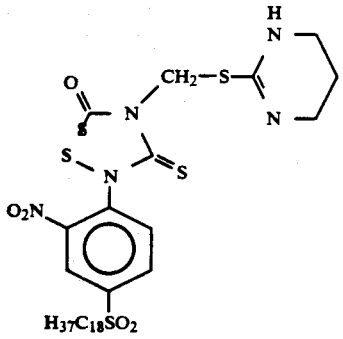
78.
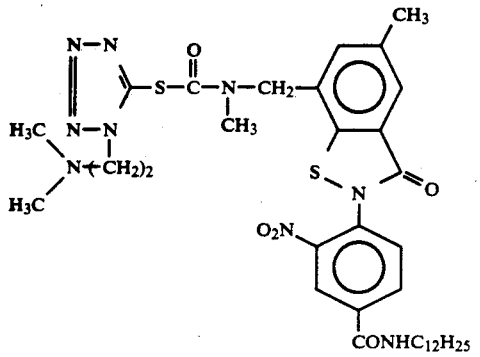

-continued

79.

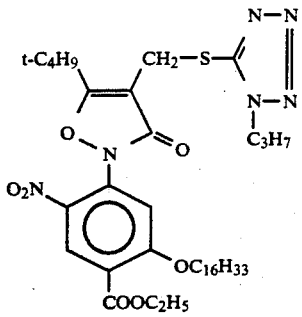

80.

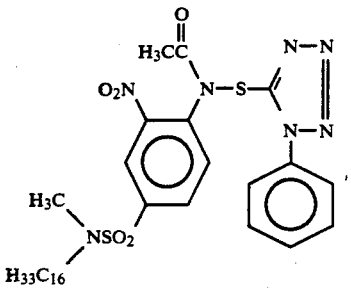

81.

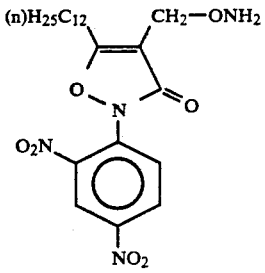

82.

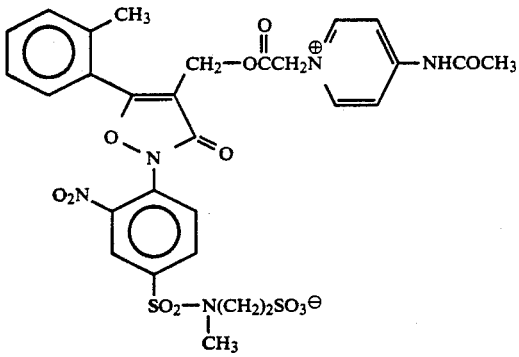

The compounds which can be used in the invention can be incorporated into the photosensitive element or image receiving element as they are using conventional methods of emulsification and dispersion or using conventional methods of dissolution and dispersion.

Methods for the synthesis of the compounds which are used in the invention are described in detail below.

The moiety represented by PWR in the compounds represented by general formula [I] can be synthesized by the synthesis methods described in the documents mentioned earlier in the detailed description of the PWR moiety (U.S. Pat. Nos. 4,139,389, 4,139,379, 4,564,577, Japanese Pat. application (OPI) Nos. 185333/84, 84453/82, U.S. Pat. No. 4,232,107, Japanese Pat. application (OPI) No. 101649/84, *Research Disclosure* (1984) IV No. 24025, Japanese Patent Application (OPI) No. 88257/86, West German Patent Application (OLS) No. 3,008,588, Japanese Pat. application (OPI) No. 142530/81, U.S. Pat. Nos. 4,343,893, 4,619,884, 4,450,223, and 4,609,610). Methods for the synthesis of PWR in the compounds represented by general formula [II] will be described in detail hereinafter.

The above patents also disclose synthesis methods for the group —(Time)$_r$—PUG.

The PUG moiety can be synthesized by methods described in the patents, literature and text books, etc., mentioned in the detailed description of the photographically useful groups, and Time can be synthesized as disclosed in Japanese Pat. application (OPI) Nos. 147244/86, 244873/85 and the patents mentioned therein.

Methods for the synthesis of compounds represented by general formula [II] have been described in Japanese Pat. application Nos. 88625/86, 87721/86, 34954/87 and 34953/87.

SYNTHESIS EXAMPLE 1

Synthesis of Compound 11

The compounds cited can be synthesized easily by referring to the methods disclosed in the following publications and patents.

*Mitsui Laboratories Annual Reports*, volume 22, page 215 (1970), Japanese Patent Publication No. 9675/77, *Bulletin de la Societe Chemique de France*, page 1978, Japanese Patent Application (OPI) Nos. 206668/82 and 206667/82, *Tetrahedron*, volume 20, page 2835 (1964), Japanese Pat. application (OPI) Nos. 194867/83 and 70878/82, Japanese Patent Publication 48935/74, Japanese Pat. application (OPI) No. 190977/84, *Journal of Organic Chemistry*, volume 48, page 4307 (1983), *Chemical and Pharmaceutical Bulletin*, volume 14, page 277, *Heterocycles*, volume 12, No. 10, page 1297, *Canadian Journal of Chemistry*, volume 62, page 1940 and Japanese Pat. application (OPI) No. 501907/84, etc.

One specific procedure is indicated below.

Step 1: Synthesis of 5-t-Butyl-3-hydroxyiso-oxazole

Hydroxylamine hydrochloride (583.7 grams) was dissolved in 2 liters of a 4N aqueous solution of sodium hydroxide, 2 liters of ethanol were added with ice cooling, a mixture of 4N sodium hydroxide ethanol (1:1) was added and the pH of the solution was adjusted to 10.0. A solution of 1380 grams of ethylpivaloyl acetate in a mixture of aqueous 4N sodium hydroxide and ethanol (1:1) was drip fed into this solution while adjusting the pH of the solution to 10.0±0.2 and maintaining the temperature within the range from 0° C. to 5° C.

After completion of the dropwise addition the reaction mixture wa stirred for two hours at room temperature and then it was poured into 6 kg of concentrated aqueous hydrochloric acid at 0° C. and left to stand for 12 hours. The crystals which precipitated out were recovered by filtration and dried after washing throughly with water.

Step 2: Synthesis of N-Hexadecyl-3-nitro-4-chlorobenzenesulfonamide

One liter of dichloromethane was mixed with 800 grams of 3-nitro 4-chlorobenzenesulfonyl chloride and a dichloromethane solution of 600 grams of hexadecylamine and 251 ml of triethylamine was added dropwise to the resulting mixture. After reaction, the reaction solvent was removed by distillation under reduced pressure, 3000 ml of methanol was added and a solution was obtained by heating. Crystals precipitated out on cooling this solution slowly. These crystals were recovered by filtration and dried.

Recovery 1020 grams, Yield 88%.

Step 3: Synthesis of N-Methyl-N-hexadecyl-3-nitro-4-chlorobenzenesulfonamide N-Hexadecyl-3-nitro-4-chlorobenzenesulfonamide (170 grams) was dissolved in 640 ml of acetone. 79 grams of potassium carbonate, 6 ml of polyethylene glycol and 71 grams of dimethylsulfate were added and the mixture was heated under reflux for a period of 5 hours. Acetone (240 ml) was then added and 870 ml of water was added dropwise at 40° C. and crystals precipitated out on cooling the mixture to room temperature. The crystals were recovered by filtration, washed with water and methanol and then dried.

Recovery 169 grams, Yield 97%.

Step 4: Synthesis of 5-t-Butyl-2-(4-N-methyl-N-hexadecylsulfamoyl-2-nitrophenyl)-4-isooxazolin-3-one.

N-Methyl-N-hexadecyl-3-nitro-4-chlorobenzenesulfonamide (470 grams), 169 grams of 5-t-butyl-3 hydroxyisooxazole, 168 grams of potassium carbonate and 1.2 liters of dimethylsulfoxide wer mixed together and reacted at 65° C. for a period of 6 hours. The reaction mixture was then poured into ice water and the crystals which separated out were recovered by filtration and dried after washing with water.

Recovery 576 grams, Yield 100%.

Step 5 Synthesis of 5-t-Butyl 4-chloromethyl-2-(4-N-methyl-N-hexadecylsulfamoyl-2-nitrophenyl)-4-iso-oxazolin-3-one 5-t-Butyl-2-(4-N-methyl-N- hexadecylsulfamoyl-2-nitrophenyl)-4-iso-oxazolin-3-one (550 grams), 200 grams of zinc chloride, 200 grams of paraformaldehyde and 1.5 liters of acetic acid were mixed together and heated under reflux for 10 hours while blowing hydrogen chloride gas into the mixture. After cooling, the reaction mixture was poured into water and the crystals which precipitated out were recovered by filtration and recrystallized from a mixture of acetonitrile and methanol (1:4).

Recovery 585 grams, Yield 96%.

Step 6: Synthesis of Compound 11

Tetramethylurea (300 ml) was added to 16.8 grams of 5-t-Butyl-4-chloromethyl-2-(4-methyl-N-hexadecylsulfamoyl-2-nitrophenyl)-4-iso-oxazolin-3-one, 10 grams of nucleating agent A*, and 10 grams of sodium iodide and the mixture was stirred at 40° C. for a period of 1 hour. The reaction mixture was then poured into dilute aqueous hydrochloric acid and extracted with ethyl acetate. The extract was washed thoroughly with salt water and then concentrated. The residue was then subjected to silica gel column chromatography and partitioned between chloroform and methanol (20:1) to obtain the target compound which was then recrystallized from methanol.

Recovery 14 grams, Yield 55%, Melting point 166 to 167° C.

* Nucleating Agent A

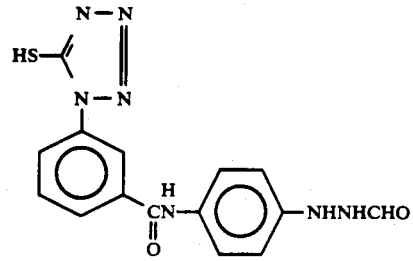

SYNTHESIS EXAMPLE 2

Synthesis of Compound 18

Step 1: Synthesis of N-methyl-N-octadecyl-5-nitro-2-chlorobenzenesulfonamide Dichloromethane (100 ml) was mixed with 44 grams of 5-nitro-2-chlorobenzenesulfonyl chloride and a dichloromethane solution which contained 48.4 grams of methyloctadecylamine and 36.1 ml of triethylamine was added dropwise to the mixture. After the reaction had been completed the reaction solvent was removed by distillation under reduced pressure, 300 ml of methanol was added and a solution was formed by heating. Crystals precipitated out on cooling the solution slowly and these were recovered by filtration and dried.

Recovery 64 grams, Yield 74%.

Step 2 Synthesis of 5-t-Butyl-2-(2-N-methyl-N-octadecylsulfamoyl-4-nitrophenyl)-4-iso-oxazolin-3-one N-methyl-N-ocatdecyl-5-nitro-2-chlorobenzenesulfonamide (62.0 grams), 20.9 grams of 5-t-butyl-3-hydroxyisooxazole, 20.7 grams of potassium carbonate and 300 ml of dimethylformamide were mixed together and were reacted for 6 hours at 80° C. The reaction mixture was then poured into ice water and extracted with ethyl acetate. The organic layer was dried and solidified under reduced pressure and the residue was refined using silica gel column chromatography. The target compound was dissolved out with a mixture of n-hexane and ethyl acetate (2:1).

Recovery 29.0 grams, Yield 37%.

Step 3: Synthesis of 5-t-Butyl 4-chloromethyl-2-(2-N-methyl-N-ocatdecylsulfamoyl-4-nitrophenyl)-4-iso-oxazolin-3-one 5-t-Butyl-2-(2-N-methyl-N-ocatadecylsulfamoyl-4-nitrophenyl)-4-iso-oxazolin-3-one (20 grams), 5.4 grams of zinc chloride, 3 grams of paraformaldehyde and 100 ml of acetic acid were mixed together and heated under reflux for 10 hours while blowing hydrogen chloride gas into the mixture. After cooling, the reaction mixture was poured into ice water and extracted with ethyl acetate. The organic layer was dried and solidified under reduced pressure and the residue was refined using silica gel chromatography. The target compound was dissolved out with a mixture of n-hexane and ethyl acetate (2:1).

Recovery 12.0 grams, Yield 58%.

Step 4: Synthesis of 4-Acetoxymethyl-5-t-butyl-2-(2-N-methyl-N-ocatadecylsulfamoyl-4-nitrophenyl)-4-iso-oxazlin-3-one Potassium acetate (12 grams) and 0.5 grams of sodium iodide were added to 200 ml of a dimethylsulfoxide solution of 20 grams of 4-chloromethyl-5-t-butyl-2-(2-N-methyl-N-octadecylsulfamoyl-4-nitrophenyl)-4-iso-oxazolin-3-one and the mixture was stirred at room temperature for a period of 5 hours. The reaction mixture was then poured into water and extracted with ethyl acetate and the extract was concentrated after washing with water. The residue was recrystallized from methanol and colorless crystals were obtained.

Recovery 16.5 grams, Yield 80%.

Step 5: Synthesis of 4-Hydroxymethyl-5-t-butyl-2-(2-N-methyl-N-octadecylsulfamoyl-4-nitrophenyl)-4-iso-oxazolin-3-one Ethanol (200 ml) was added to 15 grams of the acetoxy derivative prepared in step 4 and the mixture was heated to form a solution. Next 40 ml of 9N aqueous hydrochloric acid was added gradually to this solution and the mixture was heated under reflux for a period of 1 hour. The reaction mixture was then poured into water and extracted with ethyl acetate, the extract being concentrated after washing with water. The residue was recrystallized from methanol.

Recovery 14 grams, Yield 99%.

Step 6: Synthesis of Compound 18

Phosgene gas was blown at room temperature into a suspension of 30 grams of 4-hydroxymethyl-5-t-butyl-2-(2-N-methyl N-octadecylsulfamoyl-4-nitrophenyl)-4-iso-oxazolin-3-one in 200 ml of benzene. Once a uniform benzene solution had been obtained it was left to stand over-night at room temperature. The benzene was then removed by distillation under reduced pressure (the excess phosgene gas was removed at the same time) and the residue was dissolved in 300 ml of tetrahydrofuran. A tetrahydrofuran solution containing 13,4 grams of the phenidone compound B* and 12 ml of triethylamine was added dropwise to this solution with ice cooling. After the addition, the mixture was stirred for 1 hour at room temperature and then it was poured into dilute aqueous hydrochloric acid and extracted with ethyl acetate. The extract was washed with water and concentrated under reduced pressure, and the residue was subjected to column chromatography, the target compound being obtained in the form of a colorless solid from a chloroform fraction. Recovery 16.5 grams, Yield 41%.

* Phenidone Compound B

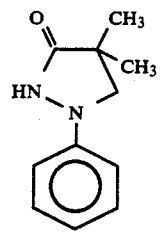

SYNTHESIS EXAMPLE 3

Synthesis of Compound 1

Step 1: Synthesis of 5-Methyl-3-hydroxyiso-oxazole

This was prepared in accordance with the method disclosed in Japanese Patent Application (OPI) No. 501907/84. Melting point 85 to 86° C.

Step 2: Synthesis of N-Hexadecyl 3-nitro-4-chlorobenzenesulfonamide

One liter of dichloromethane was mixed with 800 grams of 3-nitro-4-chlorobenzenesulfonyl chloride and a dichloromethane solution containing 600 grams of hexadecylamine and 251 ml of triethylamine was added dropwise to this mixture. After the reaction had been completed the reaction solvent was removed by distillation under reduced pressure, 3 liters of methanol was added and a solution was obtained by heating. Crystals precipitated out as the resulting solution was cooled slowly. These crystals were recovered by filtration and dried.

Recovery 1020 grams, Yield 88%.

Step 3: Synthesis of N-methyl-N-hexadecyl-3-nitro-4-chlorobenzenesulfonamide

N-Hexadecyl-3-nitro-4-chlorobenzenesulfonamide (170 grams) was dissolved in 640 ml of acetone. 79 grams of potassium carbonate, 6 ml of poly(ethylene glycol) and 71 grams of dimethylsulfate were added and the mixture was heated under reflux for a period of 5 hours. Acetone (240 ml) was added, 870 ml of water was added dropwise at 40° C. and crystals precipitated out on cooling the mixture to room temperature. The crystals were recovered by filtration, washed with water and methanol, and dried.

Recovery 169 grams, Yield 97%.

Step 4: Synthesis of 5-Methyl-2-(4-N-methyl-N-hexadecylsulfamoyl-2-nitrophenyl)-4-iso-oxazolin-3-one N-Methyl-N-hexadecyl-3-nitro-4-chlorobenzenesulfonamide (16 grams), 4.8 grams of 5-methyl-3-hydroxyiso-oxazole, 6.4 grams of sodium bicarbonate and 50 ml of dimethylsulfoxide were mixed together and reacted for 6 hours at 75° C. The reaction mixture was then poured into ice water acidified with hydrochloric acid and the crystals which precipitated out were recovered by filtration, recrystallized from methanol after washing with water, and dried.

Recovery 17.9 grams, Yield 99%.

Step 5: Synthesis of 5-Methyl-4-chloromethyl-2-(4-N-methyl-N-hexadecylsulfamoyl-2-nitrophenyl)-4-iso-oxazolin-3-one 5-Methyl-2-(4-N-methyl-N-hexadecylsulfamoyl-2-nitrophenyl)-4-iso-oxazolin-3-one (16 grams), 5 grams of zinc chloride, 7 grams of paraformaldehyde, 50 ml of acetic acid and 0.5 ml of concentrated sulfuric acid were mixed together and heated and stirred for 9 hours at 75° C. while blowing of hydrogen chloride gas into the mixture. After cooling, the reaction mixture was poured into water and the crystals which precipitated out were recovered by filtration and recrystallized from methanol.

Recovery 16.3 grams, Yield 94%.

Step 6: Synthesis of Compound 1

Benezene (50 ml) was added to 6.23 grams of 5-methyl-4-chloromethyl-2-(4-N-methyl-N-hexadecylsulfamoyl-2-nitrophenyl)-4-iso-oxazolin-3-one and 1.5 grams of mesoionic compound (a)* and the mixture was refluxed for a period of 10 hours. The solvent was then removed and the residue was recrystallized from a mixture of benzene and ethyl acetate (1:5).

*Mesoionic Compound (a)

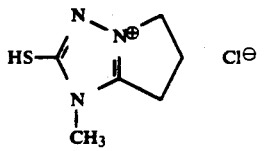

Recovery 5.8 grams, Yield 77%, Melting point 80 to 175° C., with decomposition

SYNTHESIS EXAMPLE 4

Synthesis of Compound 2

Step 1: Synthesis of Ethyl-4-chloro-3-nitro-benzoate

Methanol (17 ml) was mixed with 6 grams of 4-chloro-3-nitrobenzoid acid and the mixture was stirred at room temperature. Next 0.6 ml of concentrated sulfuric acid was added and the mixture was refluxed for a period of 4 hours. After reaction, the mixture was cooled, 17 ml of water was added and the crystals were recovered by filtration.

Recovery 6.0 grams, Yield 93.5%.

Step 2: Synthesis of 5-t-Butyl-2-(4-ethoxycarbonyl-2-nitrophenyl)-4-iso-oxazoline-3-one Ethyl-4-chloro-3-nitro-benzoate (413.3 grams), 305 grams of 5-t-butyl-3-hydroxyiso-oxazole and 1 liter of dimethylsulfoxide were mixed together and stirred. Next 300 grams of sodium bicarbonate were added and the mixture was reacted at 90° C. for a period of 8 hours. The reaction mixture was then cooled, 1.5 liter of methanol was added, followed by the addition of 3 liters of water, and the crystals which precipitated out were recovered by filtration.

Recovery 560.7 grams, Yield 93.2%.

Step 3: Synthesis of 5-t-Butyl-4-chloromethyl-2-(4-carboxy-2-nitrophenyl)-4-iso-oxazolin-3-one 5-t-Butyl-2-(4-ethoxycarbonyl-2-nitrophenyl)-4-iso-oxazoline-3-one (300.9 grams), 191.1 grams of paraformaldehyde, 191.1 grams of zinc chloride and 910 ml of acetic acid were mixed together and reacted on a steam bath for 4 hours while blowing hydrogen chloride gas into the mixture. Next 500 ml of water was added and the mixture was reacted for 2 hours. Next 500 ml of concentrated hydrochloric acid was added and the mixture was heated for a further period of 3 hours. The heating was then stopped and the reaction mixture was cooled to room temperature. The crystals which had precipitated out were recovered by filtration and dried after washing with water.

Recovery 319.3 grams, Yield 96%.

Step 4: Synthesis of 5-t-Butyl-4-chloromethyl-2-(4-n-hexadecylcarbamoyl-2-nitrophenyl)-4-iso-oxazolin-3-one Ethyl acetate (480 ml) was mixed with 81.6 grams of 5-t-butyl-4-chloromethyl-2-(4-carboxy-2-nitrophenyl)-4-iso-oxazolin-3-one and the mixture was cooled to −15° C. Triethylamine (32.6 ml) was added dropwise to this suspension and then 22.0 ml of ethylchlorocarbonate was added dropwise while maintaining the temperature below −10° C. Hexadecylamine (49 grams) was added after reacting for a further period of 50 minutes. After reacting the mixture at −10° C. for a period of 10 minutes the temperature was gradually raised to room temperature and the mixture was left to stand overnight. Next 400 ml of water was added, the mixture was separated and the organic layer was recovered and concentrated to dryness. The residue was recrystallized from methanol.

Recovery 100.9 grams, Yield 75.9%.

Step 5: Synthesis of Compound 2

Uracil (5.6 grams) was dissolved in 20 ml of dimethylformamide and 8 ml of triethylamine was added. 5-t-Butyl-4-chloromethyl-2-(4-n-hexadecylcarbamoyl-2-nitrophenyl)-4-iso-oxazolin-3-one (15 grams) was added and the mixture was stirred at room temperature for a period of 5 hours. The reaction mixture was then poured into dilute aqueous hydrochloric acid, ethyl acetate was added and the mixture was stirred. The raw material uracil crystals which formed were removed by filtration and the filtrate was left to separate. The organic layer was recovered and concentrated after washing with water. The residue was then recrystallized from methanol.

Recovery 5.4 grams, Yield 32%, melting point 53 to 56° C.

The amounts of the compounds of formulae (I) to (III) which are used can vary over a wide range. The preferred amount differs according to the nature of PUG. For example, when PUG is a development inhibitor it is preferably used at a rate of from about $1\times10^{-7}$ mol to $1\times10^{-4}$ mol, and most preferably at a rate of from about $5\times10^{-4}$ mol to $5\times10^{-2}$ mol, per mol of silver halide. The addition of a similar amount is preferred when PUG is a development accelerator, nucleating agent, image stabilizer or toning agent. When the PUG is a silver halide solvent the compound is preferably used at a rate of from 0.5 mol to 4 mol, and most preferably at a rate of from 0.8 mol to 2.2 mol, per mol of silver halide. The use of from $1\times10^{-3}$ mol to 1 mol, and essentially of from $1\times10^{-2}$ mol to 0.7 mol, per mol of silver halide is preferred when PUG is an ultraviolet absorber.

The compounds of this invention release a photographically useful group or a precursor thereof by accepting an electron from a reducing substance. Hence, the photographically useful group can be released uniformly if the reducing substance is used uniformly, or the photographically useful group or precursor thereof can be released in the form of a counter-image if the reducing substance is converted to an oxidized form corresponding to the image.

Particular embodiments of the silver salt diffusion transfer method of this invention in which compounds of the invention are employed are indicated below, but the present invention is not to be construed as being limited thereto.

(1) A compound of this invention in which PUG is a silver halide solvent is incorporated into the photosensitive element. In this case the silver halide solvent is released when the compound makes contact and reacts with the reducing agent in the processing composition and this dissolves the undeveloped silver halide. The silver complex which is formed in this way diffuses into the image receiving layer, physical development occurs, and an image is formed. In this case the compound can be incorporated into the photosensitive element in just the amount required to dissolve the silver halide, and there is no inhibition of physical development in the image receiving layer and the image is able to form quickly. Moreover, it is possible to reduce the amount of silver halide solvent used, and there is less precipitation on the surface of the image receiving sheet. Furthermore, when it is incorporated in a photosensitive element the compound of this invention has the advantage of providing better long term storage properties than the incorporation of the silver halide solvent itself.

(2) A compound of this invention in which pug is a toning agent is incorporated into the image forming layer. In the past the toning agent has been adsorbed on the silver precipitation nuclei and s the nuclei have been poisoned. In this embodiment the toning agent starts to act on contact with the reducing agent in the processing composition and so the poisoning referred to above does not occur and the image is able to form quickly. Furthermore there is no effect on the photosensitive layer when just the amount required for toning is incorporated and so once again the image can be formed quickly.

(3) A compound of this invention in which PUG is an image stabilizer (which has in the past been introduced into the timing layer of an image receiving sheet) is used in the image receiving layer. In this case there is no poisoning of the silver precipitation nuclei prior to physical development and so the image stabilizing effect can be greatly increased by using the preferred amount.

(4) When a compound of this invention in which PUG is a nucleating agent is incorporated into the photosensitive element it has no effect prior to development, and since the nucleating agent itself is first released on contact with the reducing agent in the processing composition, development can be stopped at the proper level.

(5) A compound of this invention in which PUG is a highly polymerized ultraviolet absorber is incorporated into the image receiving layer. There is no effect on the silver precipitation nuclei, and since the ultraviolet absorber itself is first released on contact with the reducing agent in the processing composition, it does not flow-out during the coating operation and there is no contamination of the coating machine, and moreover there is no effect on image formation but deterioration of the image due to ultraviolet radiation can be avoided.

The reducing substance which is used in the invention may be an inorganic compound or an organic compound and those which have an oxidation potential below the standard silver ion/silver redox potential of 0.80 V are preferred.

Examples of inorganic compounds include the metals of which the oxidation potential is less than 0.8 V, for example manganese, titanium, silicon, zinc, chromium, iron, cobalt, molybdenum, tin, lead, tungsten, antimony, copper, and mercury, or hydrogen etc. Moreover those ions or complex compounds which have an oxidation potential of less than 0.8 V, for example $Cr^{2\oplus}$, $V^{2\oplus}$, $Cu^{2\oplus}$, $Fe^{2\oplus}$, $MnO_4^{2\ominus}$, $I^{\ominus}$, $Co(CN)_6^{4\ominus}$, $Fe(CN)_6^{4\ominus}$, or $(Fe\text{-}EDTA)^{2\ominus}$ etc. are also included. Moreover those metal hydrides which have an oxidation potential of less than 0.8 V, for example sodium hydride, lithium hydride, potassium hydride, sodium borohydride, lithium borohydride, $LiAl(OC_4H_9\text{-}t)_3H$ and $LiAl(OCH_3)_3H$ etc. are also included. Furthermore those sulfur or phosphorus compounds which have an oxidation potential of less than 0.8V, for example $Na_2SO_3$, NaHS, $NaHSO_3$, $H_3P$, $H_2S$, $Na_2S$ and $Na_2S_2$ etc. are also included.

The organic reducing substances include organic nitrogen compounds such as aliphatic amines and aromatic amines, organic sulfur compounds such as aliphatic thiols and aromatic thiols and organic phosphorus compounds such as aliphatic phosphines and aromatic phosphines, but compounds which obey the Kendal-Peltz law as described in T.H. *James The theory of the Photographic Process* page 299, (4th edition), are preferred.

Examples of compounds which can be used as the reducing substance in this invention include inorganic reducing agents such as sodium sulfite and sodium bisulfite, and benzenesulfinic acid, hydroxylamines, hydrazines, hydrazides, borane-amine complexes, hydroquinones, aminophenols, catechols, p-phenylenediamines, 3-pyrazolidinones, hydroxytetronic acid, ascorbic acid, 4-amino-5-pyrazones, etc., and also the reducing agents disclosed on pages 219 to 334 of the aforementioned book by T.H. James. Furthermore the reducing agent precursors disclosed in Japanese Pat. application (OPI) No. 138736/81 and 40245/82, and U.S. Pat. No. 4,330,617, etc., can also be used.

Examples of the preferred reducing agents are indicated below.

3-Pyrazolidones and precursors thereof [for example 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-pheyl-5-methyl-3-pyrazolidone, 1-phenyl-4,4-bis(hydroxymethyl)-3-pyrazolidone, 1,4-dimethyl-3-pyrazolidone, . 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl) 4-methyl 3-pyrazolidone, 1-(2-tolyl)-4-methyl-3-pyrazolidone, 1-(4-tolyl)-3-pyrazolidione, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone, 1,5-diphenyl-3-pyrazolidone, 1-phenyl-4-methyl 4-stearoyloxymethyl-3-pyrazolidone, 1-phenyl-4-methyl-4-lauroyloxymethyl-3-pyrazolidone, 1-phenyl-4,4-bis(lauroyloxymethyl)-3-pyrazolidone, 1-phenyl-2-acetyl-3-pyrazolidone, 1-phenylacetoxypyrazolidone], hydroquinones and precursors thereof [for example hydroquinone, toluhydroquinone, 2,6-dimethylhydroquinone, t-butylhydroquinone, 2,5-di-t-butylhydroquinone, t-octylhydroquinone, 2,5-di-t-octylhydroquinone, pentadecylhydroquinone, sodium 5-pentadecylhydroquinone-2-sulfonate, p-benzoyloxyphenol, 2-methyl-4-benzoyloxyphenol, 2-t-butyl-4-(4-chlorobenzoyloxy)phenol, sodium hydroquinone-2-sulfonate, 2-{3,5-bis(2-hexadecanamido)benzamido}hydroquinone, 2- (3-hexadecanamido)benzamidohydroquinone, 2-( 2-hexadecanamido)hydroquinone], p-phenylenediamine color developing agents [for example 4-amino-N,N-diethylaniline, 3-methyl-4-amino-N,N-diethylaniline, 4-amino N-ethyl-N-$\beta$- hydroxyethylaniline, 3-methyl-4-amino N-ethyl-N-$\beta$-hydroxyethylaniline, 3-methyl-4-amino-N-ethyl-N-$\beta$-butoxyethylaniline, 3-methyl-4-amino-N-ethyl-N-$\beta$-methanesulfonamidoethylaniline, 4-amino-3-methyl-N-ethyl-N-$\beta$-methoxyethylaniline], and the aminophenol reducing agents such as 4-amino-2,6-dichlorophenol, 4-amino-2,6-dibromophenol, 4-amino-2-methylphenol sulfate, 4-amino-3-methylphenol sulfate, 4-amino-2,6-dichlorophenol hydrochloride etc. Moreover the 2,6-dichloro-4-substituted sulfonamidophenols and 2,6-dibromo-4-substituted sulfonamido phenols disclosed in *Research Disclosure* 151, No. 15108 and in U.S. Pat. No. 4,021,240 and the p-(N,N-dialkylaminophenol)sulfamines etc. disclosed in Japanese Pat. application (OPI) No. 116740/84 are useful compounds. In addition to the above mentioned phenol based reducing agents the naphthol based reducing agents, for example, 4-aminonaphthol derivatives and 4-substituted sulfonamidonaphthol derivatives can be used. Moreover, the aminohydroxypyrazole derivatives disclosed in U.S. Pat. No. 2,895,825, the aminopyrazoline derivatives disclosed in U.S. Pat. No. 2,892,714 and the hydrazine derivatives in *Research Disclosure,* (June 1980) on pages 227 to 230 and pages 236 to 240 (RD-19412, RD-19415) have been disclosed as useful general color developing agents. These color developing agents may be used individually or in combinations of two or more types.

Useful reducing agents are indicted below, but the present invention is not to be construed as being limited thereto.

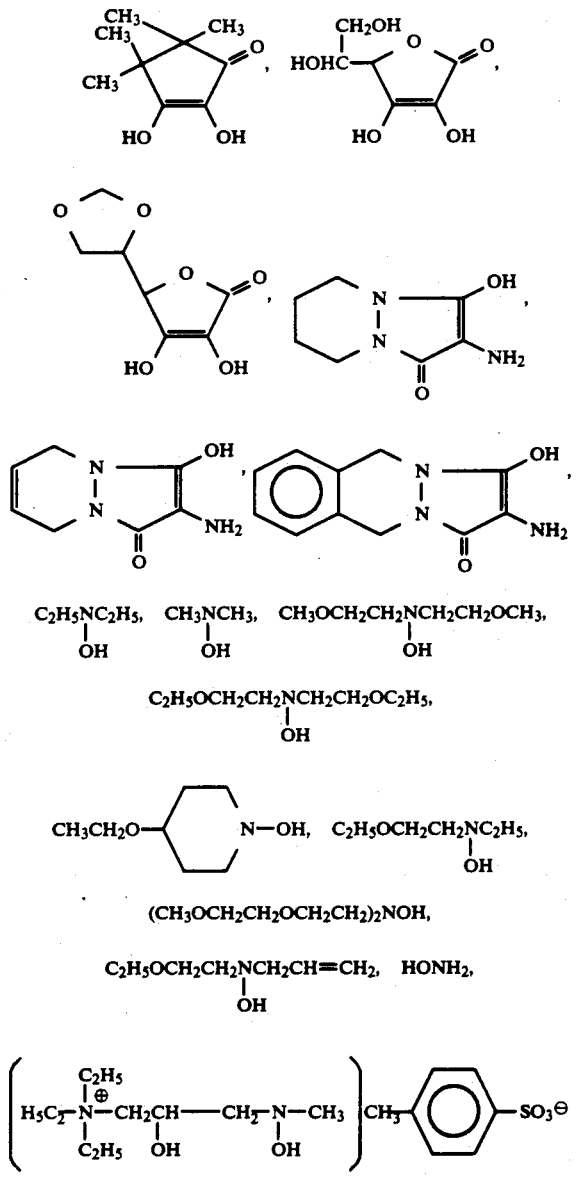

The mechanism involved when the compound of this invention acts counter-imagewise is described below in greater detail, but the present invention is not to be construed as being limited by theory.

The compound of this invention is reduced by electron transfer as indicated by the arrows in equation (1) below and releases a photographically useful group.

Equation (1)

-continued

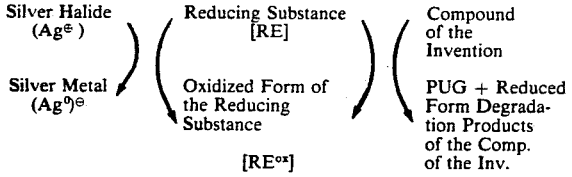

In equation (1) the reducing substance [RE] is an inorganic or organic reducing substance as aforementioned and it may be used via external application by inclusion in the processing liquid or it can be used by prior inclusion in the sensitive material, or alternatively one such reducing substance [RE]may be included in the sensitive material and the same type or a different type of reducing substance [RE]may be applied via the processing liquid In cases where a conventional negative type silver halide emulsion is used the reducing substance [RE] is consumed by reducing the silver halide in accordance with the degree of exposure and so the extent of the reaction with the compounds of this invention has a counter-correspondence with the extent of exposure, which is to say that only the remainder of the reducing substance [RE] which has been supplied which has not be used in the reduction of silver halide is used for this purpose. Hence the photographically useful group is released in greater amounts in the parts which have received a low level of exposure Furthermore, in cases where an autopositive emulsion is used, the silver halide is reduced in the unexposed parts, the reverse of the situation in the case of a negative type emulsion, and so the reducing substance is consumed in the unexposed parts. Hence in this case the compounds of this invention react with the reducing substances in larger amounts in the parts which have received a high level of exposure and the photographically useful groups are released in greater quantities in these parts.

As described above, the compounds of this invention release small amounts of the photographically useful group in the developed parts (the parts where the reducing substance has reacted with the silver halide) and large amounts of the photographically useful group in the undeveloped parts, but a reducing substance known as an electron transfer agent [ETA] can be used conjointly as shown in equation (2) below with a view to adjusting the ratio of the amounts of the photographically useful group which are released in the developed and undeveloped parts (these substances are normally used to raise this ratio).

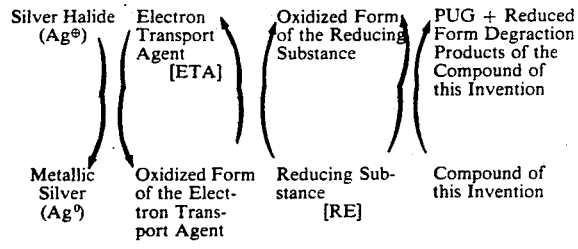

The electron transfer agent [ETA]in equation (2) can be selected from among the reducing substances described earlier and it is preferably selected from among the organic reducing substances. Moreover in order to achieve the best effect the redox potential of the electron transfer agent [ETA] is preferably located between those of the reducing substance [RE] and the silver halide.

The methods whereby the reducing substance is made to act upon the electron transfer agent are the same as those described in connection with the reducing substance RE] in equation (1).

The process by which the photographically useful group is released in equation (2) is the same that as described in connection with formula (1), except that the transfer of the electron from the reducing substance to the silver halide proceeds via the electron transfer agent. In some cases the reducing substance in equation (2) is immobile, the transfer of an electron from the reducing substance to the silver halide occur slowly. It can be seen from equation (1) that if the transfer of electrons from the reducing substance to the silver halide is slow then the reaction between the reducing substance and the compound of this invention will take place preferentially and so the difference between the amounts of the photographically useful group released in the developed and undeveloped parts will be reduced. An electron transfer agent is able to transfer electrons from an immobile reducing substance to the silver halide smoothly and it can be used to increase the difference between the amounts of the photographically useful group which are released in the exposed and unexposed parts. In order to achieve the above mentioned aim it is essential that the electron transfer agent which is used conjointly with an immobile reducing substance [RE] should have a higher mobility than the reducing substance [RE]. Effective use can be made of an immobile reducing substance by using an electron transfer agent in the way shown in equation (2).

The reducing substances used in combination with an ETA may be any of the aforementioned reducing agents which have essentially no mobility in the layers of the photosensitive material, but the use of hydroquinones, aminophenols, aminonaphthols, 3-pyrazolidinones, saccharin and precursors thereof, picolinium compounds and the compounds disclosed as electron donors in Japanese Pat. application (OPI) No. 110827/78 is preferred. Examples of these are indicated below.

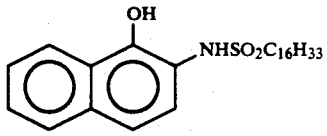
S-1
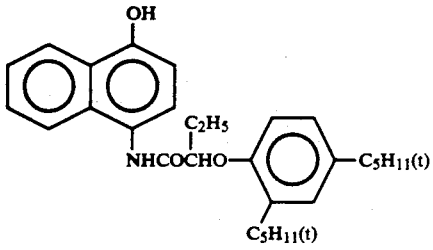
S-2
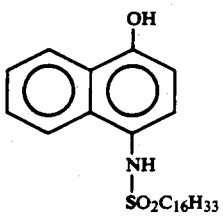
S-3
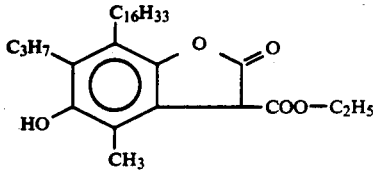
S-4
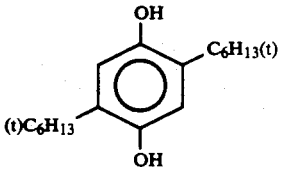
S-5
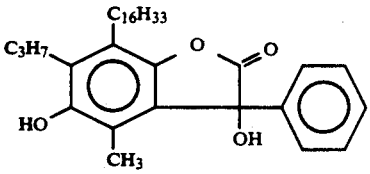
S-6
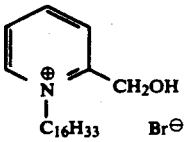
S-7
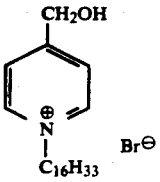
S-8
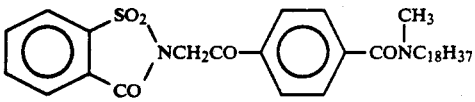
S-9

-continued
S-10
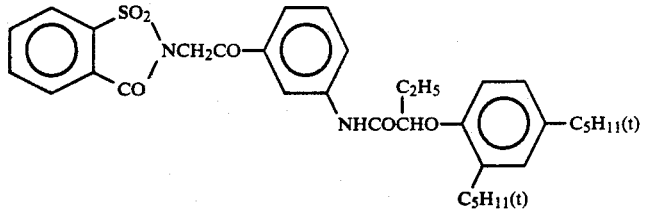
S-11
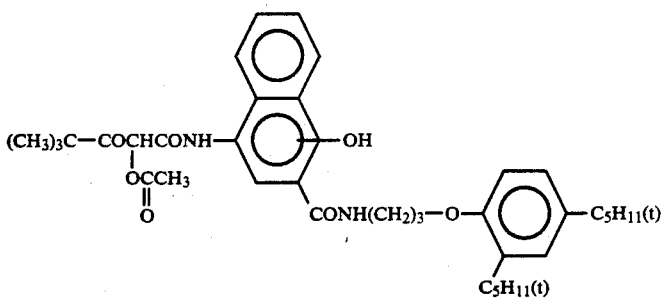
S-12
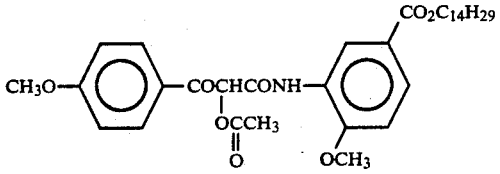
S-13
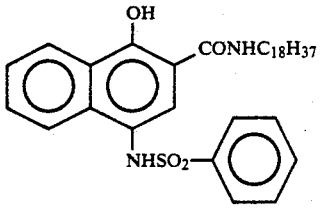
S-14
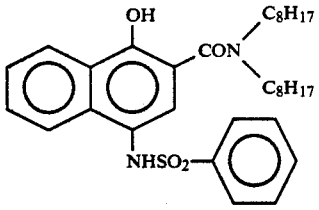
S-15
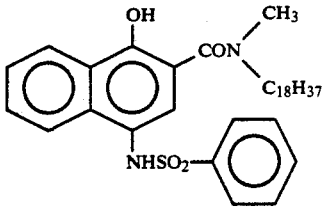
S-16
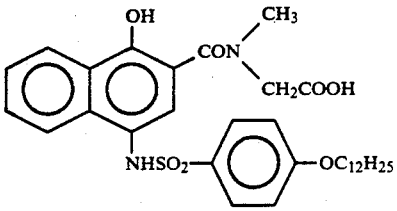

-continued
S-17
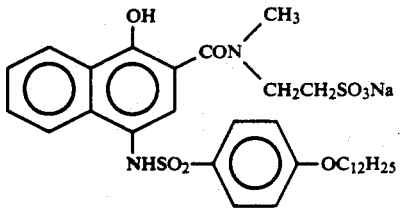
S-18
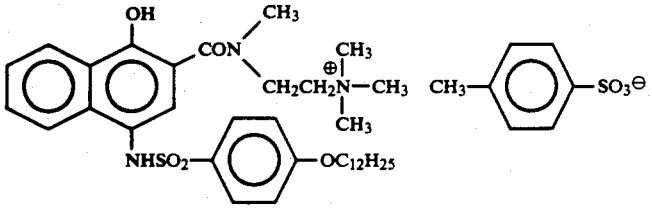
S-19
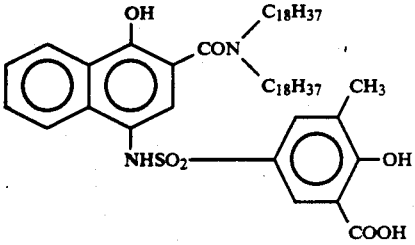
S-20
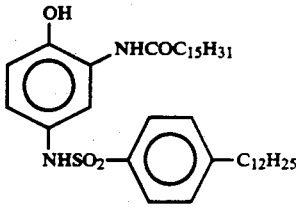
S-21
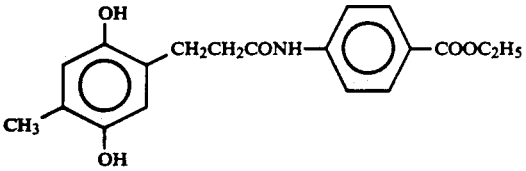
S-22
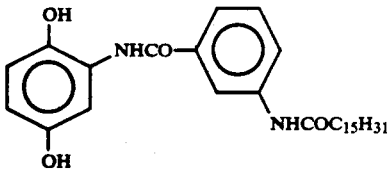
S-23
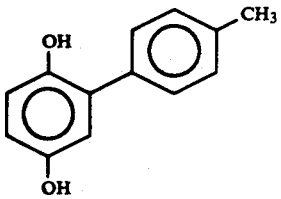
S-24
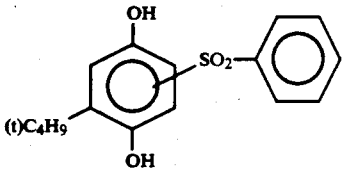

-continued
S-25
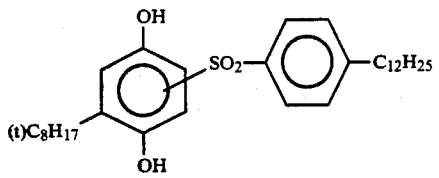
S-26
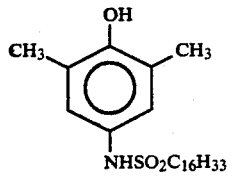
S-27
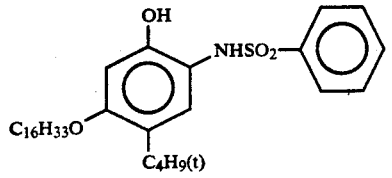
S-28
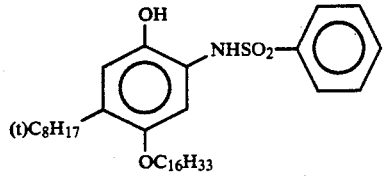
S-29
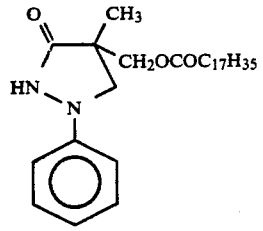
S-30
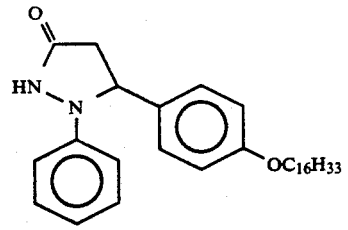
S-31
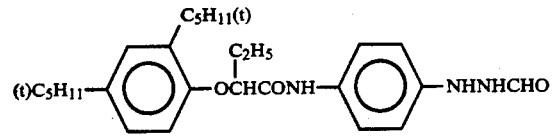
S-32
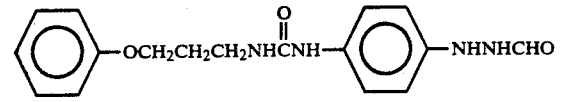
S-33
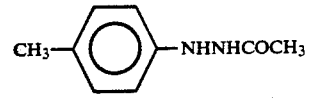

-continued
S-34
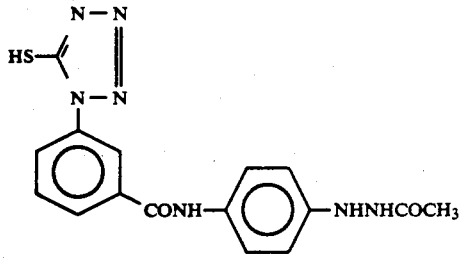
S-35
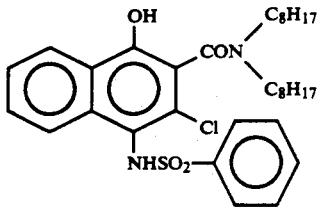
S-36
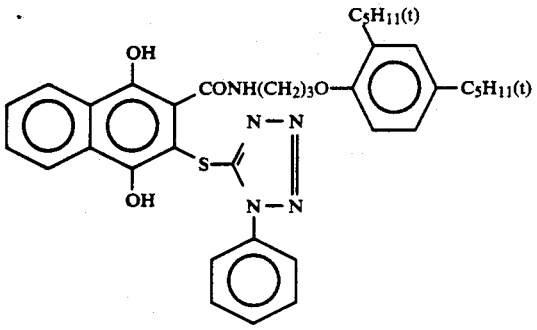
S-37
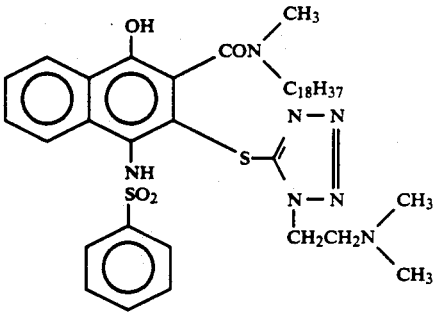
S-38
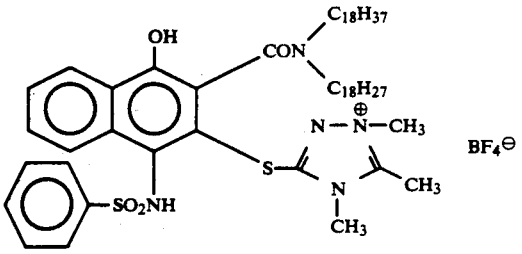
S-39
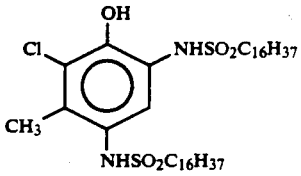

-continued
S-40
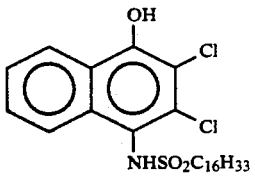
S-41
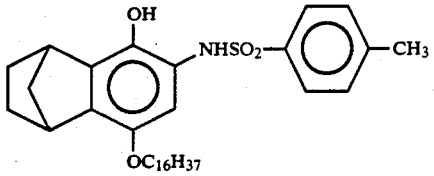
S-42
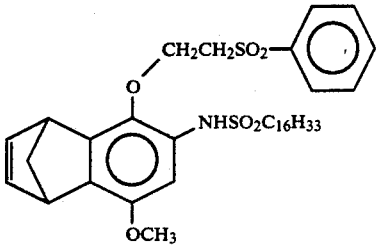
S-43
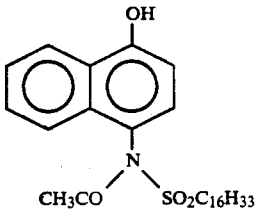
S-44
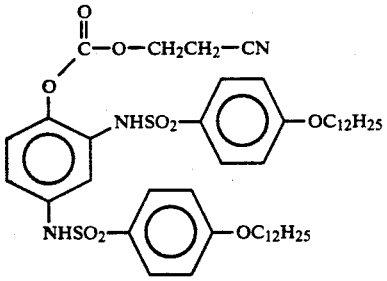
S-45
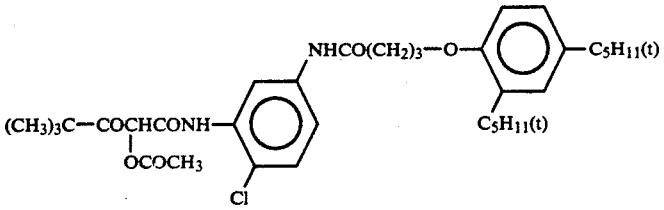
S-46
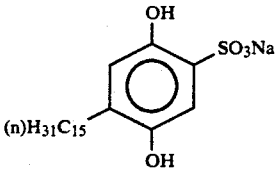

-continued

S-47

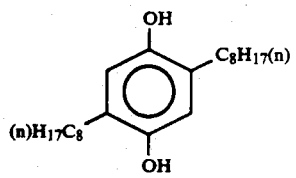

S-48

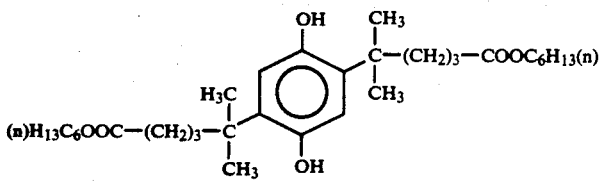

S-49

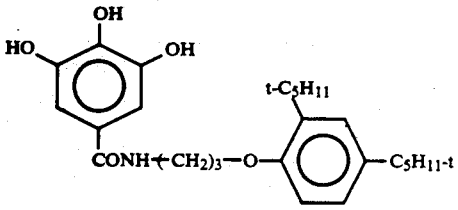

S-50

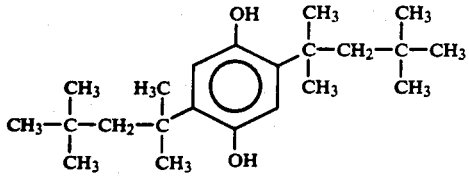

S-51

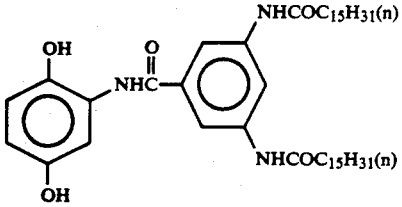

S-52

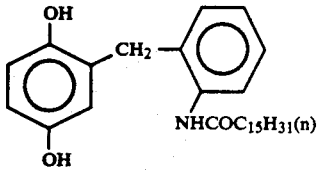

S-53

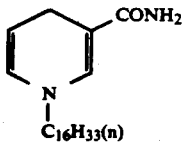

In cases where the processing liquid used in the invention is distributed as a thin layer between the laminated photosensitive and image receiving elements the liquid preferably contains a polymeric film forming agent, thickening agent or viscosity increasing agent. Hydroxyethylcellulose and sodium carboxymethylcellulose are especially useful for this purpose and they are included in the processing liquid at a concentration which is effective for providing an appropriate viscosity in accordance with the known general principles of diffusion transfer photography. Other auxiliary agents known in silver salt transfer photographic procedures, for example fogging agents, toning agents, stabilizers etc., may also be included in the processing liquid. The inclusion of oxyethylamino compounds, for example triethanolamine, is especially useful for extending the storage life of the processing liquid, as disclosed in U.S. Pat. No. 3,619,185.

The processing liquids of the type described above are preferably housed in a rupturable container in the form of a processing element. The rupturable container and the material thereof may be any of the known types, details of which have been disclosed for example in U.S. Pat. No. 3,056,491, 3,056,492, 3,173,580, 3,750,907, 3,833,381, 4,303,750 and 4,303,751, etc.

The image receiving elements in this invention have an image receiving layer which contains a silver precipitating agent coated onto a support which consists of, for example, baryta paper, cellulose triacetate or polyester. Image receiving layers of this type can be made by covering a support which has been undercoated, as required, with a coating solution of an appropriate cellulose ester, for example cellulose diacetate, in which a silver precipitating agent has been dispersed. The cellulose ester layer so obtained is hydrolyzed with a alkali and at least some of the depth of the cellulose ester is converted to cellulose. In an especially useful embodiment one or more mercapto compounds useful for improving the tone of the silver transfer image, the stability, or some other photographic property is included in the silver precipitating layer and/or underlying cellulose lower layer which has not been subjected to hydrolysis, for example in the parts where the polyester layer which contains cellulose diacetate has not been subjected to hydrolysis. Mercapto compounds of this type are used on diffusing from their original position during imbibition. Image receiving elements of this type have been disclosed in U.S. Pat. No. 3,607,269.

Actual examples of silver precipitating agents include the heavy metals, for example iron, lead, zinc, nickel, cadmium, tin, chromium, copper, cobalt, and more especially the precious metals, for example gold, silver, platinum and palladium. Other useful silver precipitating agents include heavy metal sulfides and selenides, especially the sulfides of mercury, copper, aluminum, zinc, cadmium, cobalt, nickel, silver, lead, antimony, bismuth, cerium, magnesium, gold, platinum and palladium and the selenides of lead, zinc, antimony and nickel.

The use of gold, platinum, palladium or sulfides thereof is especially desirable.

Furthermore, an acidic polymer layer for neutralization purposes is preferably established between the image receiving layer and the support. The preferred acidic polymers include copolymers of unsaturated carboxylic acids such as acrylic acid, maleic acid, methacrylic acid, itaconic acid and crotonic acid, and acidic cellulose derivatives. Actual examples include for example butyl acrylate/acrylic acid copolymers, cellulose acetate hydrodienephthalate, ethyl methacrylate/methacrylic acid copolymers, methyl methacrylate/methacrylic acid copolymers, etc. Other polymers which contain sulfonic acid groups such as poly(styrene sulfonic acid) and acetalated products of benzaldehyde sulfonic acid and poly(vinyl alcohol) are use useful for this purpose.

Furthermore, the inclusion in the image receiving sheet of a image stabilizing layer for improving the storage properties of the image is also desirable, and the cationic polymeric electrolytes are preferred the stabilizers. The preferred cationic polymeric electrolytes include the aqueous latex dispersions disclosed in Japanese Pat. application (OPI) No. 166940/84, and Japanese Pat. application (OPI) Nos. 142339/80, 126027/79, 155835/79, 30328/78 and 92274/79, the polyvinylpyridinium salts disclosed in U.S. Pat. Nos. 2,548,564, 3,148,061 and 3,756,810, the water soluble quaternary ammonium salt polymers disclosed in U.S. Pat. No. 3,709,690 and the water soluble quaternary ammonium salt polymers disclosed in U.S. Pat. No. 3,898,088.

Furthermore, cellulose acetate is preferred as the binder for the image stabilization layer, and a cellulose acetate of which the degree of acetylation is from 40 to 49% is especially desirable.

Moreover, an intermediate layer is preferably established between the image receiving layer and the layer which contains the toning agent, stabilizer etc. This intermediate layer preferably consists of gum arabic, poly(vinyl alcohol), polyacrylamide.

A peeling layer is preferably established on the surface of the image receiving layer for preventing the attachment of the processing liquid to the surface of the image receiving layer on peeling apart after spreading the processing liquid. Gum arabic, hydroxyethylcellulose, methylcellulose, poly(vinyl alcohol), polyacrylamide or sodium alginate, or the materials disclosed in U.S. Pat. No. 3,772,024 and 3,820,999 or in British Patent 1,360,653 are preferably used for such a peeling layer.

In special embodiments of the invention the image receiving layer can be incorporated into the photosensitive element as described below. For example, in a preferred embodiment an image receiving layer which contains a silver precipitating agent, a light-reflecting layer which contains a white pigment such as titanium dioxide etc., a light shielding layer which contains a light absorbing substance such as carbon black and photosensitive silver halide emulsion layer are established sequentially on a polyethyleneterephthalate sheet. In such an embodiment the back layer is covered by the light reflecting layer and so the image which has formed in the image forming layer can be viewed through the polyethyleneterephthalate sheet without peeling off the photosensitive silver halide emulsion layer after the diffusion transfer process.

Moreover, the use of a photosensitive element obtained by coating a photosensitive silver halide emulsion onto a support is preferred in this invention.

Silver bromide, silver iodobromide, silver iodochlorobromide, silver chlorobromide or silver chloride can be used for the silver halide in the photosensitive silver halide emulsion which is used in this invention. The preferred silver halide is a silver iodobromide or silver iodochlorobromide which contains not more than about 10 mol % of iodine. The use of a silver iodobromide which contains from about 3 mol % to 10 mol % of silver iodide is especially desirable.

The average grain size of the silver halide grains in the photosensitive emulsion is of no particular significance but it is preferably not more than about 3μ, more preferably not more than about 1.5μ and most preferably within the range from about 0.5 to 1.4μ (When the grains are approximately spherical the grain size is the diameter of the grain, and in the case of cubic grains the size of the grain is the side length, and the average size is based on projected areas.).

The grains size distribution may be narrow or wide.

The silver halide grains in the photosensitive emulsion may have the crystal form of an regular crystal system such as a cubic or octahedral form, or they may have an irregular crystal form such as a spherical or plate-like form, or alternatively they may have a complex crystal form consisting a combination of these crystalline forms. Mixtures of grains of various crystal forms can also be used.

The silver halide grains may consist of an inner part and a surface layer of different phases or they may consist of a homogeneous phase. Furthermore the silver halide may be of the type in which the latent image is formed principally on the surface of the grains or of the type in which the latent image is formed within the grains. The use of grains with which the latent image is formed principally on the surface of the grains is preferred.

The thickness of the photosensitive emulsion layer is from about 0.5 to 8,0 μ, and preferably form about 0.6 to 6.0 μ, and the coated weight of silver halide grains is from about 0.1 to 3 g/m², and preferably from about 0.2 to 1.5 g/m².

The photosensitive emulsion can be prepared using the methods normally used for silver halide photographic emulsions and it may be chemically sensitized and spectrally sensitized as required. Moreover anti-fogging agents, stabilizers, film hardening agents, coating promoters, anti static agent, etc. may be included in the emulsion. Furthermore a vehicle such as gelatin is used in the emulsion.

The exposure for obtaining a photographic image can be carried out using conventional methods. Thus various known light sources such as natural light (daylight), tungsten lamps, fluorescent lamps, mercury lamps, xenon arc lamps, carbon arc lamps, xenon flash lamps, cathode ray tube flying spots etc. can be used for this purpose. Exposure times from 1/1000$^{th}$ of a second to 1 second are used in an ordinary camera, and exposure times of less than 1/1000$^{th}$ of a second, for example exposures of from $1/10^4$ to $1/10^6$ seconds obtained using a xenon strobe lamp or a cathode ray tube can be used, and long exposure of more than 1 second can also be used. The spectral composition of the light used for the exposure can be adjusted using filters as required. Laser light can also be used for making the exposure. Furthermore the light released from a phosphor which has been excited by an electron beam, X-rays, γ-rays, α-rays etc. can also be used from making the exposure.

The arrangements of the elements and methods of bonding when assembling the photosensitive, image receiving and processing elements of the type described above into a film unit are disclosed in Nablette, *Handbook of Photography and Reprography* page 282 to 285 (7th ed.) and a preferred embodiment is described in detail in U.S. Pat. No. 3,350,991.

This invention can be applied not only to the type of units in which a photosensitive element is peeled off the image forming element after spreading the processing composition but also to units having a unified structure.

The invention is described in greater detail with reference to specific examples, but the invention is not to be construed as being limited by the examples. Unless otherwise indicated, all parts, percents and ratios are by weight.

EXAMPLE 1

A standard sample for comparative purposes is described first.

The Photosensitive Sheet

Silver halide grains were formed physically ripened in the usual way, de-salted and chemically ripened in the usual way and a silver iodobromide emulsion (iodide content 5.5 mol %) was obtained. The average diameter of the silver halide grains contained in this emulsion was 0.9 micron and 1 kg of the emulsion contained 0.65 mol of silver halide. The emulsion was collected in 1 kg pots and melted in a constant temperature bath at 50° C. Ten ml of an aqueous solution containing 1 wt % of the orthochromatic sensitizing dye 3-{5-chloro-2-[2-ethyl-3-(3- ethyl-2- benzothiazolinyidine)-propenyl]- 3-benzoxazoxazolio}propane sulfonate and the panchromatic sensitizing dyes (4-{2-[(3-ethylbenzothiazolin-(2-iridene)-2-methyl-1-propenyl]-3-benzothiazolio}butane sulfonate) and 4-hydroxy-6-methyl-1,3,3a,7-tetrazaindene respectively, 10 ml of a 1 wt % aqueous solution of 2-hydroxy-4,6-dichlorotriazine sodium salt, 10 ml of a 1 wt % aqueous solution of sodium dodecylbenzenesulfonate, and 10 ml of a 0.1 wt % methanol solution of lipoic acid were added and mixed by stirring at 40° C. The finished emulsion was coated to provide a dry film thickness of 3 microns on an undercoated polyethyleneterephthalate base which contained titanium dioxide and the finished sample was obtained on drying. At the same time, a poly(methyl methacrylate) latex (average size 3.5μ) was added to aqueous gelatin solution and coated on the sample to provide a dry film thickness of 1 micron. The coated silver weight was 0.5 g/m².

The Image Receiving Sheet

A mixture of cellulose acetate (54% acetylated) and methyl vinyl ether-maleic anhydride copolymer were coated at rates of 6 g/m² and 4 g/m², respectively on a polyethylene laminated paper to form a neutralizing layer. The compounds indicated below were mixed with 46% acetylated cellulose acetate and coated and dried to form image stabilizing layers by coating at the rates of 2 g/m² and 4 g/m², respectively.

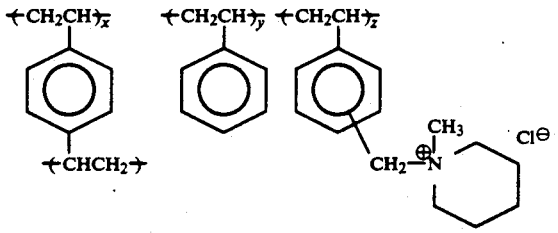

x:y:z = 5:47.5:47.5

Cellulose acetate (55% acetylated) and 1-(4-hexylcarbamoylphenyl)-2,3-dihydroimidazol-2-thione were then coated at rates of 8.5 g/m² and 0.15 g/m² respectively to from a timing layer. Moreover, aqueous solutions of dimethylolurea (5%) and acetic acid (50%) were added at concentrations of 5% and 1.25% respectively to a 5% aqueous solution of polyacrylamide and the mixture was coated over the above mentioned layer at the rate of 25 ml/m² to form an intermediate layer. Moreover, a liquid consisting of a fine dispersion of palladium sulfide as a silver precipitating agent ($7.5\times10^{-4}$ g/m²) in a 3% acetone/methanol (9/1) solution of cellulose acetate and 1-phenyl-5-mercaptoimidazole at a concentration providing a coated weight of $1.25\times10^{-6}$ mol/m² were coated over the top of the above mentioned layer as an image receiving layer. The dry film thickness was 0.8 μm. The alkali solution indicated below was coated onto the coated material at a rate of 18 ml/m² and the material was rinsed with water and dried and moreover the image receiving sheet was completed by coating with 0.04 g/m² of butyl methacrylate-acrylic acid copolymer (mol ratio 15:85) as a peeling layer.

| Alkali Solution | |
|---|---|
| Potassium hydroxide (purity 86%) | 44.3 grams |

-continued

| | |
|---|---|
| Water | 200 ml |
| Methanol | 800 ml |
| The Processing Liquid | |
| Potassium hydroxide (85%) | 260 grams |
| Titanium dioxide | 3 grams |
| Uracil | 45 grams |
| 6-Methyluracil | 45 grams |
| Hydroxyethylcellulose | 70 grams |
| Zinc oxide | 10 grams |
| N,N-bismethoxyethylhydroxylamine | 50 grams |
| Triethanolamine | 7 grams |
| Tetrahydropyrimidinethione | 0.4 gram |
| Sodium 5-mercaptotetrazoyl-benzenesulfonate | 0.1 gram |
| 2,4-Dimercaptopyrimidine | 0.35 gram |
| Water to make | 2 kg |

A sample of this invention is described below.

Thus compound 2 containing the uracil contained in the above-mentioned processing composition as PUG was included in the photosensitive element in a containing amount of 0.006 mol/m$^2$ (0.7 g/m$^2$ as uracil) and the uracil and 6-methyluracil were omitted from the processing composition. This was sample 101.

Comparative sample 102 was prepared in the following way:

0.7 g/m$^2$ of uracil was included in the photosensitive element and the uracil and 6-methyluracil were omitted from the processing composition.

The photographic properties of the samples were measured in tests carried out immediately after coating and after storing for 5 day at 60° C., 40% RH. The measurement of photographic properties involved measuring the relative speed and the maximum density of the image transferred onto the image receiving sheet after 25° C.30 sec. peeling (here and below the expression "X° C.y sec. (or min.) peeling" signifies that the image receiving sheet was peeled off the photosensitive sheet after spreading the alkali processing liquid between the photosensitive sheet and the image receiving sheet at a temperature of X° C. and carrying out the alkali processing for a period of y seconds (or minutes)).

Furthermore dusting was monitored after leaving the image receiving sheet to stand for 3 days at 60° C., 90% RH, after subjecting the sample to 25° C.20 sec. peeling immediately after coating.

The results obtained are shown in Table 1.

TABLE 1

| | Immediately After Coating | | After 5 days at 60° C., 40% RH | | |
|---|---|---|---|---|---|
| Sample | Max. Dens. | Rel. Speed | Max. Dens. | Rel. Speed | Dusting |
| 101 | 1.80 | 100 | 1.78 | 99 | None |
| 102 | 1.73 | 96 | 1.53 | 81 | None |
| Ref.* | 1.80 | set at 100 | — | — | Slight precipitation |

*Standard sample

With comparative sample 102 the maximum density and the relative speed were lower than those of the standard sample due to the addition of the uracil to the photosensitive layer, and the extent of the lowering of these factors increased as the samples aged. On the other hand with sample 101 in which a compound in which uracil formed a PUG was added to the photosensitive layer in accordance with the invention, there was no lowering of the maximum density or relative speed immediately after coating and there was hardly any decrease in these values after aging. Moreover, the dusting which occurred with the standard sample did not occur in the case of sample 101 of this invention.

EXAMPLE 2

Compound 4 in which the tetrahydropyrimidinethione included in the processing composition of the standard sample in Example 1 formed the PUG was included in the image receiving layer at a rate of $3\times10^{-5}$ mol/m$^2$ (3.5 mg/m$^2$ as tetrahydropyrimidinethione) and the tetrahydropyrimidinethione was omitted from the processing composition. (Sample 201 of the invention)

On the other hand tetrahydropyrimidinethione was included in the image receiving layer at a rate of 3.5 mg/m$^2$ or 7 mg/m$^2$ (the amount when the content in the processing composition was calculated as an amount in the image receiving layer) and the tetrahydropyrimidinethione was omitted from the processing composition. (Comparative samples 202 and 203)

Test: The photographic properties were measured with 25° C.30 sec. peeling.

TABLE 2

| Sample | Maximum Density | Relative Speed | Tone |
|---|---|---|---|
| 201 | 1.80 | 100 | Pure black |
| 202 | 1.65 | 118 | Gray |
| 203 | 1.52 | 129 | Gray |
| Standard | 1.80 | Set to 100 | Pure black |

The same results were obtained on adding smaller quantities.

EXAMPLE 3

Compound 6 in which the 1-(4-hexylcarbamoylphenyl)-2,3-dihydroimidazole-2-thione contained in the timing layer of the image receiving sheet of the standard sample in Example 1 formed the PUG was included in the image receiving layer at a rate of just $6.6\times10^{-5}$ mol/m$^2$ (0.02 g/m$^2$ as 1-(4-hexylcarbamoylphenyl)-2,3-dihydroimidazole-2-thione) and the 1-(4-hexylcarbamoylphenyl)-2,3-dihydroimidazole-2-thione was omitted from the timing layer. (Sample 301 of this invention)

On the other hand, 1-(4-hexylcarbamoylphenyl)-2,3-dihydroimidazole-2-thione was included at rates of 0.01 g/m$^2$ (Comparative sample 302) and 0.02 g/m$^2$ (Comparative sample 303) in the image receiving layer and omitted from the timing layer.

Test: Photographic properties were measured immediately after peeling apart 25° C.30 sec. peeling and 25° C.10 min. peeling samples and the changes in the photographic properties after 5 days at 60° C., 90% RH (foot part fading $= -\Delta D_{0.5}$, Color change $= -\Delta D_{max}$) were measured.

TABLE 3

| | 20° C. · 30 sec | | 25° C. · 10 min. | | | | | |
|---|---|---|---|---|---|---|---|---|
| | Maximum | Relative | Maximum | Relative | 25° C. · 30 sec | | 25° C. · 10 min. | |
| Sample | Density | Speed | Density | Speed | $-\Delta D_{0.5}$ | $-D_{max}$ | $-\Delta D_{0.5}$ | $-D_{max}$ |
| 301 | 1.80 | 100 | 1.84 | 98 | 0.01 | 0.05 | 0.05 | 0.02 |
| 302 | 1.83 | 95 | 1.88 | 95 | 0.08 | 0.15 | 0.16 | 0.05 |
| 303 | 1.48 | 123 | 1.65 | 110 | 0.03 | 0.05 | 0.07 | 0.03 |
| Standard | 1.80 | 100 | 1.84 | 98 | 0.01 | 0.07 | 0.07 | 0.03 |

EXAMPLE 4

Compound 8 of this invention in which the compound indicated below formed the PUG was included in the photosensitive element of the standard sample in Example 1 at a rate of $2\times10^{-4}$ mol/m$^2$ (0.09 g/m$^2$ as the PUG compound itself). (Sample 401 of the invention)

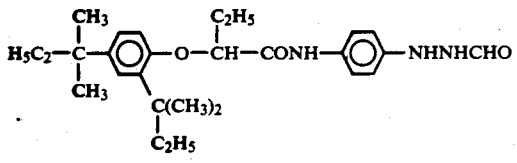

On the other hand the above illustrated compound was included in the photosensitive element of the standard sample in Example 1 at a rate of 0.09 g/m$^2$ (Comparative sample 402)

Test: Photographic properties (maximum density, relative speed, gradation) were measured with 25° C.30 sec. and 25° C.10 min. peeling and with 25° C.30 sec. peeling after standing for 5 days at 60° C., 40% RH.

TABLE 4

| | 25° C. · 30 sec. | | | 25° C. · 10 min. | | | 5 days 60° C., 40% RH, 25° C. · 30 sec. | | |
|---|---|---|---|---|---|---|---|---|---|
| Sample | Maximum Density | Relative Speed | Gradation | Maximum Density | Relative Speed | Gradation | Maximum Speed | Relative Speed | Gradation |
| 401 | 1.80 | 100 | 1.10 | 1.82 | 98 | 1.20 | 1.79 | 98 | 1.12 |
| 402 | 1.78 | 102 | 1.12 | 1.80 | 100 | 1.25 | 1.72 | 95 | 1.28 |
| Standard | 1.80 | 100 | 1.35 | 1.84 | 98 | 1.50 | 1.79 | 98 | 1.37 |

The gradation value of 1.10 of this invention was better than that of the standard, the change between 30 seconds and 10 minutes was small and moreover there was little change after aging at 60° C.

EXAMPLE 5

Compound 10 of this invention in which the compound indicated below formed the PUG was included at the rate of $2\times10^{-3}$ mol/m$^2$ (0.15 g/m$^2$ as the PUG compound in the image forming layer of the standard sample. (Sample 501 of this invention)

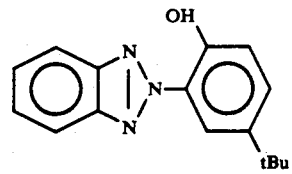

On the other hand the above-illustrated compound itself was included in the image receiving layer at the rate of 0.15 g/m$^2$. (Comparative sample 502)

Test: The photographic properties with 25° C.10 min. peeling, the reflectance at 380 nm and the extent of image fading ($-\Delta D_{0.5}$) on illuminating the sample with a 20000 lux xenon lamp for a period of 1 week were measured.

TABLE 5

| | 25° C. · 10 min. | | | 25° C. · 10 min. 2000 lux × 1 week |
|---|---|---|---|---|
| Sample | Maximum Density | Relative Speed | Reflectance | $-\Delta D_{0.5}$ |
| 501 | 1.84 | 98 | 0.54 | 0.02 |
| 502 | 1.84 | 98 | 0.13 | 0.02 |
| Standard | 1.84 | 98 | 0.55 | 0.08 |

The ultraviolet absorber which is unstable in alkali and turns yellow did not change color and could be used effectively.

EXAMPLE 6

Compound 8 in Example 4 and S-46 were each included at a rate of $2\times0^{-4}$ mol/m$^2$ in the photosensitive element. (Sample 601 of this invention)

Test: The photographic properties of 25° C.30 sec. peeling and 10 min. peeling samples were measured.

TABLE 6

| | 25° C. · 30 sec. | | | 25° C. · 10 min. | | |
|---|---|---|---|---|---|---|
| Sample | Maximum Density | Relative Speed | Gradation | Maximum Density | Relative Speed | Gradation |
| 601 | 1.80 | 100 | 1.10 | 1.81 | 99 | 1.14 |
| 602 | 1.80 | 100 | 1.10 | 1.82 | 98 | 1.20 |
| Standard | 1.80 | 100 | 1.35 | 1.84 | 98 | 1.50 |

The co-presence of a compound of this invention and a reducing agent had a marked effect. In this example there was hardly any change in gradation even when the peeling time was changed.

While the invention has been described in detail and with reference to specific embodiments thereof, it will be apparent to one skilled in the art that various changes and modifications can be made therein without departing from the spirit and scope thereof.

It is claimed:

1. A method for forming an image by silver salt diffusion transfer comprising processing an imagewise exposed photosensitive element provided with a layer of photosensitive silver halide emulsion on a support, and an image-receiving element provided with an image-receiving layer containing a silver-precipitating agent on a support, with an alkali processing composition in the presence of a silver halide solvent, to convert at least part of unexposed silver halide in said emulsion layer into a transferable silver complex salt, to transfer at least part of said complex salt into said image-receiving layer, and to form an image in said image-receiving layer; and process being carried out in the presence of at least one compound represented by general formula (I):

$$\text{PWR—(Time)}_t\text{—PUG} \qquad \text{(I)}$$

wherein PWR represents a group capable of releasing—(Time)$_t$—PUG by an oxidation-reduction reaction; Time represents a group capable of releasing PUG after —(Time)$_t$—PUG is released from PWR; t is 0 or 1; and PUG represents a photographically useful group selected from the group consisting of, a nucleating agent and an ultraviolet absorber.

2. The method as claimed in claim 1, wherein said photographically useful group is a polymeric ultraviolet absorber and said compound represented by general formula (I) is present in said image receiving layer.

3. The method as claimed in claim 1, wherein said compound represented by general formula (I) is represented by general formula (II):

(II)

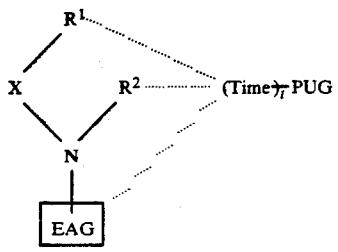

wherein X represents an oxygen atom, a sulfur atom or a group

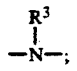

$R^1$, $R^2$ and $R^3$, which may be the same or different, each represents a substituted or unsubstituted alkyl group, a substituted or unsubstituted aralkyl group, a substituted or unsubstituted alkenyl group, a substituted or unsubstituted alkynyl group, a substituted or unsubstituted aryl group, a substituted or unsubstituted heterocyclic group, a substituted or unsubstituted acyl group, a substituted or unsubstituted sulfonyl group, a substituted or unsubstituted carbamoyl group or a substituted or unsubstituted sulfamoyl group: EAG represents an aromatic group capable of accepting an electron rom a reducing substance; and Time, t and PUG are each as defined in formula (I); provided that at least one of $R^1$, $R^2$ and EAG is bonded to —(Time)$_t$—PUG, $R^1$ and $R^2$ may each represent a simple bond to —(TIME)$_t$—PUG; and any of $R^1$, $R^2$, $R^3$ and EAG may be linked to form at least one five-membered to eight-membered ring, wherein the bond between the nitrogen atom and X is cleaved when EAG accepts an electron.

4. The method as claimed in claim 3, wherein $R^1$ and $R^3$ each represents a substituted or unsubstituted alkyl group, a substituted or unsubstituted alkenyl group, a substituted or unsubstituted alkynyl group, a substituted or unsubstituted aryl group, a substituted or unsubstituted heterocyclic group, a substituted or unsubstituted acyl group, or a substituted or unsubstituted sulfonyl group; and $R^2$ represents a substituted or unsubstituted acyl group or a substituted or unsubstituted sulfonyl group.

5. The method as claimed in claim 3, wherein said compound represented by general formula (II) is represented by general formula (III):

(III)

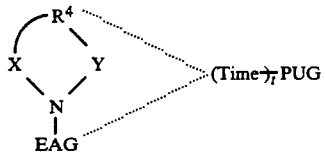

wherein EAG, X, Time, t and PUG are each as defined in general formula (II); Y represents a divalent linking group; $R^4$ represents an atomic group necessary for forming a 5-membered to 8-membered heterocyclic ring or condensed heterocyclic ring; and at least one of $R^4$ and EAG is bonded to —(Time)$_t$—PUG.

6. The method as claimed in claim 5, wherein said divalent linking group is a

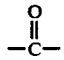

group or an —$SO_2$— group.

7. The method as claimed in claim 3, wherein EAG is represented by general formula (A):

(A)

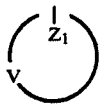

wherein $Z_1$ represents a

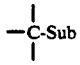

group or a nitrogen atom; V represents an atomic group necessary for forming a 3-membered to 8-membered aromatic ring containing members selected from

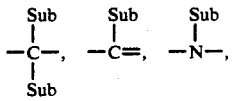

—N=, —O—, —S— and —$SO_2$, wherein Sub represents a hydrogen atom or a substituent group, and plural Sub groups may be the same or different; provided that the sum of the para Hammett substituent constances of said Sub groups is at least +0.05, and further provided that at least two Sub groups may be linked to form a 3-membered to 8-membered saturated or unsaturated carbocyclic ring or a 3-membered to 8-membered saturated or unsaturated heterocyclic ring.

8. The method as claimed in claim 1, wherein when said photographically useful group is a nucleating agent, said compound represented by formula (I) is present in an amount of from about $1\times10^{-7}$ mol to $1\times10^{-1}$ mol per mol of said silver halide; and when said photographically useful group is an ultraviolet absorber, said compound represented by formula (I) is present in an amount of from about $1\times10^{-3}$ mol to 1 mol per mol of said silver halide.

9. The method as claimed in claim 8, wherein when said photographically useful group is a nucleating agent, said compound represented by formula (I) is present in an amount of from about $5\times10^{-4}$ to $5\times10^{-2}$ mol per mol of said silver halide; and when said photographically useful group is an ultraviolet absorber, said compound represented by formula (I) is present in an amount of from about $1\times10^{-2}$ mol to 0.7 mol per mol of said silver halide.

10. The method as claimed in claim 3, wherein X represents an oxygen atom.

11. The method as claimed in claim 3, wherein X represents a sulfur atom.

12. The method as claimed in claim 3, wherein X represents a group $$-\overset{\overset{\displaystyle R^3}{|}}{N}-.$$

13. The method as claimed in claim 1, wherein said photographically useful group is a nucleating agent and said compound represented by general formula (I) is present in said light-sensitive silver halide emulsion layer.

14. The method as claimed in claim 1, wherein said image-receiving layer comprises a silver precipitating agent capable of converting said silver complex salt, selected from the group consisting of a heavy metal, a precious metal, a heavy metal sulfide, and a heavy metal selenide.

15. The method as claimed in claim 14, wherein said silver precipitating agent is selected from the group consisting of gold sulfide platinum, platinum sulfide, palladium and palladium sulfide.

* * * * *